US012781531B2

(12) United States Patent
Dash

(10) Patent No.: US 12,781,531 B2
(45) Date of Patent: Nov. 3, 2026

(54) YIELDING FENCE SYSTEM WITH SELECTIVELY LOCKABLE PIVOTAL PANELS

(71) Applicant: Melon Dash, Sarasota, FL (US)

(72) Inventor: Melon Dash, Sarasota, FL (US)

( * ) Notice: Subject to any disclaimer, the term of this patent is extended or adjusted under 35 U.S.C. 154(b) by 0 days.

(21) Appl. No.: 19/403,778

(22) Filed: Nov. 28, 2025

(65) Prior Publication Data

US 2026/0146470 A1 May 28, 2026

Related U.S. Application Data

(60) Provisional application No. 63/724,792, filed on Nov. 25, 2024.

(51) Int. Cl.
*E04H 17/14* (2006.01)
*E04H 17/00* (2006.01)

(52) U.S. Cl.
CPC ..... *E04H 17/1445* (2021.01); *E04H 17/017* (2021.01); *E04H 17/143* (2013.01)

(58) Field of Classification Search
CPC . E04H 17/143; E04H 17/017; E04H 17/1417; E04H 17/1447; E04H 17/163; E04H 17/003; E04H 17/1445
USPC ..... 256/24, 73
See application file for complete search history.

(56) References Cited

U.S. PATENT DOCUMENTS 379,706 A * 3/1888 Landis ..... E04H 17/143 256/DIG. 4
932,232 A * 8/1909 Adams ..... E05B 53/003 292/171
1,056,576 A * 3/1913 Olson ..... F16B 7/0433 256/73
2,587,167 A * 2/1952 Kelley ..... E05B 65/0007 256/73
3,332,182 A * 7/1967 Mark ..... E04B 2/7453 411/116
3,342,458 A * 9/1967 Simonton ..... E04H 17/143 256/73
3,801,072 A * 4/1974 Newberry, Jr. ..... E04H 17/1602 256/19
3,933,311 A * 1/1976 Lemelson ..... E04H 17/16 239/289
4,078,772 A * 3/1978 Carbone ..... E04H 17/1447 256/65.04

(Continued)

*Primary Examiner* — Daniel J Wiley
(74) *Attorney, Agent, or Firm* — Mooney IP

(57) ABSTRACT

Systems and techniques may generally be used for a fence configurable between a static state and a dynamic state. A system may include a plurality of structural support posts and at least one panel disposed between two of the posts. A rotational coupling assembly may pivotally connect the panel to the two posts to define a pivot axis. A releasable locking mechanism may be configured to selectively secure the panel in a fixed, non-rotational orientation in the static state, and may be further configured to permit 360 degree rotation of the panel about the pivot axis in the dynamic state in response to aerodynamic loading. Implementations may include upper- or lower-edge placement of the rotational coupling assembly, manual or electromagnetic locking, and panel cartridges adapted for serviceability and varied surface constructions, while maintaining the selectable transition between privacy/security operation and wind-responsive operation.

17 Claims, 9 Drawing Sheets

(56) References Cited

U.S. PATENT DOCUMENTS 4,471,947 A * 9/1984 Osborne ..... E04H 17/143 256/69
4,712,773 A * 12/1987 Larson ..... A47D 13/065 256/25
4,899,991 A * 2/1990 Brunkan ..... E04H 17/1447 256/65.06
5,100,108 A * 3/1992 Schultz ..... E04H 3/12 256/73
5,364,076 A * 11/1994 Nicholls ..... E04H 17/168 256/22
5,372,354 A * 12/1994 Cacicedo ..... E04H 17/1439 256/22
7,461,489 B2 * 12/2008 Herbertsson ..... E04H 17/165 256/22
7,857,291 B2 * 12/2010 Dombroski ..... E04H 17/185 256/12.5
8,607,844 B2 * 12/2013 Meza ..... E05B 65/006 160/368.1
9,187,926 B2 * 11/2015 Machacek ..... E04H 17/163
12,006,720 B2 * 6/2024 Stucchi ..... E04H 17/161
2003/0030047 A1 * 2/2003 Ohanesian ..... E04H 17/1602 256/24
2004/0041142 A1 * 3/2004 Morgan ..... E04H 17/1447 256/65.08
2006/0150546 A1 * 7/2006 Fumagalli ..... E01F 13/022 52/235
2006/0273294 A1 * 12/2006 Dombroski ..... E04H 17/185 256/24
2008/0217598 A1 * 9/2008 Dombroski ..... E04H 17/185 256/24
2008/0265233 A1 * 10/2008 Flannery ..... E06B 9/04 256/73
2011/0193041 A1 * 8/2011 Stull ..... E05F 15/614 256/73
2014/0252293 A1 * 9/2014 Miller ..... E06B 11/02 256/73
2014/0283760 A1 * 9/2014 Garcia Rey ..... A01K 15/04 119/843
2016/0083974 A1 * 3/2016 Meza ..... E04H 17/17 248/219.4
2016/0335931 A1 * 11/2016 Dalton ..... G09F 7/22
2018/0119445 A1 * 5/2018 McCarroll ..... E04H 17/1447
2019/0120268 A1 * 4/2019 Hill ..... E04H 17/146
2022/0106747 A1 * 4/2022 Ferguson ..... E04H 15/005

* cited by examiner

YIELDING FENCE SYSTEM WITH SELECTIVELY LOCKABLE PIVOTAL PANELS

BACKGROUND OF THE INVENTION

Technical Field

The present disclosure generally relates to outdoor barrier systems and structural assemblies, and more particularly to fence systems having configurable panels, rotational couplings, and selective retention mechanisms for operation in variable environmental conditions.

Description of the Related Art

Conventional fences are commonly constructed as fixed, non-yielding structures with panels rigidly fastened to posts, which may lead to repeated damage or service demands in high wind environments. Known approaches include proprietary flexible fence products and hinged or articulating panel concepts that restrict travel or rely on limited movement ranges, which may introduce load concentrations, maintenance concerns, or installation complexity. Commercial offerings sometimes emphasize convenience kits, lighter-duty posts, or narrow-angle motion stops that may be overpowered during severe conditions, potentially resulting in component failure or misalignment. Prior publications describe panel movement that appears constrained to discrete orientations. Systems marketed under names like FlexFence indicate configurable slat or panel arrangements but may utilize post and hardware selections that are not optimized for prolonged, repeated wind loading. These arrangements are widely known and serve as representative examples of established practices in the field.

SUMMARY OF THE INVENTION

Embodiments of the invention may include one or more of the following features. These features may be used singly, or in combination with each other.

In general, in a first aspect, the technologies described herein relate to a yielding fence system that may be configurable between a static state and a dynamic state. The system may include a plurality of structural support posts, at least one panel disposed between two of the posts, a rotational coupling assembly that may pivotally connect the panel to the two posts to define a pivot axis, and at least one releasable locking mechanism that may selectively secure the panel in a fixed, non-rotational orientation in the static state and may permit substantially free rotation of the panel about the pivot axis in the dynamic state in response to aerodynamic loading.

In general, in a second aspect, the technologies described herein relate to configurations in which the rotational coupling assembly may be disposed near an upper horizontal edge of the panel such that, in the dynamic state, the panel may rotate from a bottom edge in a pendulous motion.

In general, in a third aspect, the technologies described herein relate to configurations in which the rotational coupling assembly may be disposed along a bottom horizontal edge of the panel such that, in the dynamic state, the panel may rotate to a substantially horizontal orientation proximate to a substrate.

Embodiments of the invention may include one or more of the following features. These features may be used singly, or in combination with each other. The rotational coupling assembly may include a singular, horizontally oriented cylindrical pipe member integrated with the panel and a pair of sleeve members affixed to the posts to rotationally receive pipe ends; the pipe and sleeves may be galvanized steel; a plurality of tension bands may secure the pipe to a structural frame of the panel; posts may be 4-inch by 6-inch dimensional lumber of at least 9 feet total length and anchored to a depth of at least 33% of total post height; the panel may be a self-contained panel cartridge less than 5 feet wide; the locking mechanism may be a manually actuated slide bolt or an electromagnetic lock communicatively coupled to a control system; the control system may transition lock states based on wind-speed thresholds and may receive data from a local anemometer; at least one axial constraint member may prevent horizontal translation along the pivot axis. A method may include installing posts, fabricating panels (including one or more panel cartridges with individual pickets fastened by threaded deck screws, wherein the pickets can be made of wood or other materials), integrating the rotational coupling assembly (defining the pivot axis by affixing a cylindrical pipe via tension bands), mounting panels to posts, and affixing a releasable locking mechanism; the method may include installing an automated control system based on meteorological data and fabricating a panel using a solid vinyl sheet with an internally reinforced core. A modular panel apparatus may include a panel body, a rotational member with opposing ends defining post-mounting interfaces, and a locking component defining a corresponding locking interface; the panel body may include a rigid frame with top and bottom rails and pickets (preferably, 10 pickets), a cylindrical rotational member, and axial collars positioned inboard of the ends to limit lateral movement. Supportable embodiments may include field-removable clamping collars; internal reinforcement with metallic, fiber-reinforced polymer, honeycomb, or corrugated cores with code ratings and service tags; replaceable bushings or bearings with lubrication ports; solar/charge-controlled battery power; installation kits with alignment jigs and maintenance instructions; controller logic with hysteresis and fail-safe unlock; obstruction sensing and manual override; damping subsystems; biasing assemblies; and dielectric isolation with selected fasteners to mitigate galvanic corrosion.

The above advantages and features are of representative embodiments only, and are presented only to assist in understanding the invention. It should be understood that they are not to be considered limitations on the invention as defined by the claims. Additional features and advantages of embodiments of the invention will become apparent in the following description, from the drawings, and from the claims.

Aspects described below also include a YIELDING FENCE SYSTEM WITH SELECTIVELY LOCKABLE PIVOTAL PANELS.

BRIEF DESCRIPTION OF THE FIGURES

The appended figures depict certain features of the various aspects described herein and are not to be considered limiting of the scope of this disclosure.

DETAILED DESCRIPTION

In the following detailed description, numerous specific details are set forth by way of examples to provide a thorough understanding of the relevant teachings. However, it should be apparent that the present teachings may be practiced without such details. In other instances, well-known structures, functions, methods, procedures, components, and/or circuitry have been described at a relatively high level, without detail, to avoid unnecessarily obscuring aspects of the present teachings.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

As noted, existing opportunity-seeking platforms rely on resumes and manual triage, often surfacing outdated or irrelevant candidates and overlooking timing and location suitability. To address these challenges, techniques are described that implement the RESILIENT FENCE SYSTEM WITH SELECTIVELY LOCKABLE PIVOTAL PANELS, utilizing configurable states, robust mechanical couplings, and selective actuation to enable responsive operation and reliable, low-overhead deployment.

The RESILIENT FENCE SYSTEM WITH SELECTIVELY LOCKABLE PIVOTAL PANELS is as follows.

Figure 1:
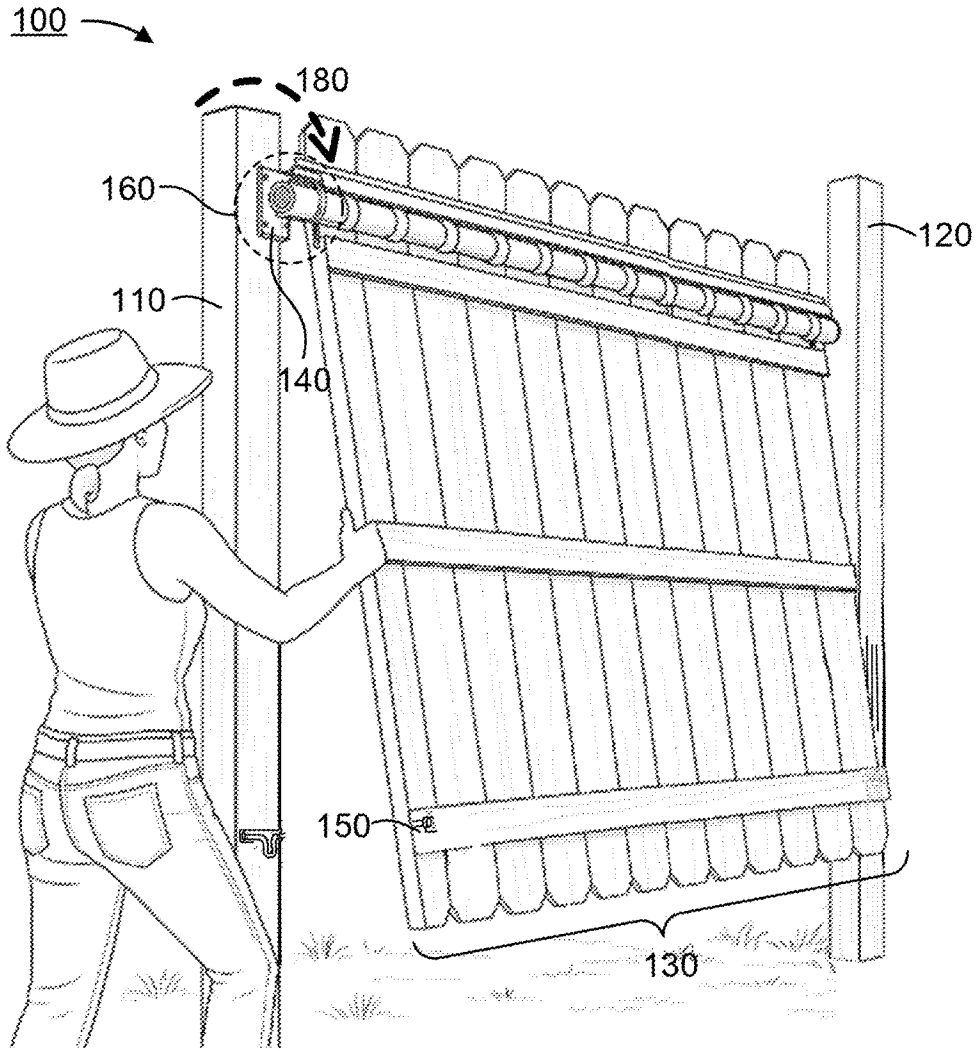
FIG. 1 depicts a single-cartridge yielding fence system including a panel between structural support posts with an upper-mounted rotational coupling assembly, a pivot axis, and a releasable locking mechanism possibly responsive to aerodynamic loading, according to various examples, as shown in some embodiments.

Referring to FIG. 1, which illustrates an overall environment 100 for a single-cartridge yielding fence system configurable between a static state and a dynamic state, a panel 130 may be disposed between a first structural support post 110 and a second structural support post 120 in an outdoor installation context. Along an upper horizontal edge of the panel 130, a rotational coupling assembly (upper-mounted variant) 140 may pivotally connect the panel 130 to the two support posts 110, 120. The rotational coupling assembly 140 may establish a horizontal pivot axis 160 about which the panel 130 may rotate. In certain aspects, the upper-edge placement may allow the panel 130 to rotate in a pendulous motion from a bottom edge under dynamic wind conditions.

The cartridge may rotate up to 360 degrees and/or through 360 degrees about the axis. A releasable locking mechanism 150 may be positioned and configured to selectively secure the panel 130 in a fixed, non-rotational orientation in the static state. In the dynamic state, when the releasable locking mechanism 150 is disengaged, the panel 130 may permit free rotation about the pivot axis 160 in response to aerodynamic loading. An aerodynamic loading vector 180 may be depicted schematically to indicate a wind-induced force that can actuate the panel 130 from a closed, fence-like orientation toward an open orientation. The structural support posts 110, 120 may provide structure for both the rotational coupling assembly 140 and the releasable locking mechanism 150. The panel 130 may include a picket-style surface panel material or a solid sheet with internal reinforcement consistent with disclosed embodiments. The geometry may illustrate clearance for rotation without fouling adjacent surfaces at the posts 110, 120 while maintaining alignment in a closed condition. The pivot axis 160 may be shown coincident with the rotational coupling assembly 140 to emphasize the axis of rotation. The releasable locking mechanism 150 may be positioned to engage or release the panel 130 relative to at least one of the posts 110, 120 to establish the static state or permit the dynamic state, respectively.

In the embodiment depicted, the rotational coupling assembly 140 defines a substantially horizontal pivot axis 160 situated proximate an upper horizontal edge of the panel 130 so that, upon disengagement of the locking mechanism 150, the panel behaves as an pendulum under aerodynamic loading 180. The aerodynamic loading 180 may be represented by a dynamic pressure proportionate to the square of the wind speed V (mph), which, when multiplied by the projected area of the panel, produces a distributed load that yields a moment about the pivot axis 160. Placement of the pivot axis 160 near the panel's top edge reduces the moment arm for uplift compared to mid-height hinges, and in some embodiments lowers torsional demand on the rotational coupling assembly 140 by encouraging early rotation at lower onset pressures, thereby limiting peak reaction forces transmitted into the structural support posts 110, 120. Also gravity may return the cartridge to a resting position.

The structural support posts 110, 120 provide a reaction frame to receive shear and bending loads induced by panel rotation, and are aligned parallel to each other to maintain a consistent cartridge width with the panel 130 disposed therebetween. The panel 130 may comprise a rigid frame and a surface panel material such as discrete pickets or a solid sheet; for picket-based constructions, inter-picket gaps reduce effective drag coefficient, while a solid sheet may rely on the yielding motion and/or a shiny smooth surface and/or semigloss paint to shed pressure. Clearances are established between lateral edges of the panel 130 and the interior faces of the posts 110, 120 to prevent binding during rotation about the pivot axis 160. Tolerances approximately 1-2" may be sufficient for wood-based systems, whereas larger allowances are contemplated for high-humidity environments where dimensional swelling is expected.

The releasable locking mechanism 150 is shown in a position enabling secure capture of the panel 130 relative to at least one of the posts 110, 120, and may be implemented as a manually actuated slide bolt or as an electromagnetic locking apparatus in other embodiments. In the manual implementation, a slide bolt may translate into a post-mounted receiver to define the fixed, non-rotational static state. In the electromagnetic implementation, a ferromagnetic keeper plate affixed to the panel 130 (or the post) may be engaged by a solenoid or electromagnet mounted correspondingly on the post 110 or 120 (or the panel), with the unlocked state obtained by removal of coil current. In either case, the locking mechanism 150 is arranged to provide a defined shear path from the panel 130 into one or both posts 110, 120 without obstructing the rotational path when disengaged.

The rotational coupling assembly 140 may be realized by a cylindrical pipe member integrated with the panel 130 and sleeves affixed to the posts 110, 120 that rotationally receive opposing ends of the pipe as detailed elsewhere. In this figure, the rotational coupling assembly 140 is schematically indicated as an upper hinge line coincident with the pivot axis 160; the actual mechanical stack-up may include tension bands, clamps, or brackets that distribute load into the panel frame. The rotational coupling assembly 140 is configured to provide low-friction rotation and may include bushings or lubricant films to limit wear under cyclic wind excitation under heat, humidity, and cyclic conditions. If the sleeve-to-pipe interface employs a press-fit or polymer-lined bushing, the coefficient of friction and thermal expansion of the materials should be selected to avoid cold-binding in expected temperature ranges.

Interaction between components proceeds as follows: with the locking mechanism 150 engaged, the panel 130 is immobilized in the static state and aerodynamic loading 180 is reacted primarily as a lateral force into the posts 110, 120 with negligible rotation about the pivot axis 160. Upon disengagement of the locking mechanism 150, aerodynamic loading 180 produces a moment that overcomes static friction in the rotational coupling assembly 140, causing the panel 130 to rotate upward from its bottom edge in either direction in a pendulous motion, thereby reducing projected area normal to the wind and limiting peak forces. When the wind subsides, gravity restores the panel 130 to the closed orientation, at which point the locking mechanism 150 may be re-engaged to reestablish the static state.

Configuration variability is contemplated without departing from the illustrated relationships. The pivot axis 160 may be positioned near the bottom edge to produce a dropdown behavior, or the panel 130 may be partitioned into sub-panels, similar to prior art, with independent rotational coupling assemblies according to prior art. The locking mechanism 150 may be located at a lower edge for convenient access or at mid-height to reduce panel twist under latch loads. The panel 130 may be formed as a self-contained panel cartridge whose width is selected to maintain favorable mass and inertia characteristics, with widths under five feet advantageously reducing torsional loading on the rotational coupling assembly 140. If a solid-sheet surface panel material is used, an internal reinforcement may be added to control panel deflection; the depiction here is compatible with such reinforcements although not expressly shown.

In some embodiments, a control strategy coordinates the transition between static and dynamic states by commanding the locking mechanism 150 to disengage based on sensed or forecast wind speeds. Although not visible in this figure, a control system may compute a threshold unlocking wind speed at which the benefit of panel rotation outweighs the benefit of remaining closed for privacy. Hysteresis may be applied so that the re-lock wind speed is set below the unlocking threshold to prevent chatter. If a time-averaging filter is used to suppress false triggers due to gusts, the filter window should be sized to balance responsiveness with stability under site-specific gust statistics.

Mechanical design considerations include selection of corrosion-resistant materials for the rotational coupling assembly 140 and the locking mechanism 150. Fasteners may be selected to resist vibration loosening during repeated wind-induced oscillations. The interface between the rotational coupling assembly 140 and the panel 130 is preferably distributed at multiple points along the width to reduce localized crushing of wood fibers or creep in polymeric substrates. Where posts 110, 120 are embedded in soil, vertical alignment should be maintained to avoid lateral binding of the pivot path, and the distance between posts should be controlled within a tolerance band that accommodates thermal expansion of the panel 130 and its hardware.

From an operational standpoint, the system may be configured so that a user disengages the locking mechanism 150 in anticipation of a wind event. In automated embodiments, a control system may provide notifications and execute an unlock command at or before a wind threshold. The panel 130's rotation is passive, driven by aerodynamic loading 180, and the free-swing clearance around the bottom edge should be ensured so that the panel does not contact obstructions during dynamic motion. If a damping component is later added to modulate closing speed, it should be positioned so as not to interfere with the kinematics of the rotational coupling assembly 140.

Manufacturing and installation align with best practices for hinged outdoor structures. Holes for the rotational coupling assembly 140 may be located using a jig to align the pivot axis 160 across the cartridge defined by the posts 110, 120. The locking mechanism 150 is positioned so its engagement path is orthogonal to the plane of the panel 130 in the static state and/or are made to align, reducing rubbing during thermal cycling. Sealants or protective caps may be applied at hardware penetrations to limit moisture ingress.

The figure accommodates aesthetic and privacy choices without altering the fundamental mechanics. Pickets may be spaced to achieve a selected opacity, or a solid panel may be textured to simulate pickets. Coatings or finishes are selected for UV durability and low friction at hardware interfaces. If a decorative capping is installed atop the panel 130, its mass contribution should be considered in the inertia about the pivot axis 160.

In use cases such as residential property boundaries, the panel 130 ordinarily remains in the static state for privacy and security, and transitions to the dynamic state only when disengagement of the locking mechanism 150 is desired to withstand extreme wind events. In coastal or open-field installations, the dynamic state may be used more frequently, and the rotational coupling assembly 140 may be specified with higher cycle life components.

In some embodiments, onset of rotation may be tuned by adjusting the normal force in clamp-type elements that form part of the rotational coupling assembly 140 so that static friction aligns with a design wind onset. Once rotation begins, aerodynamic torque generally increases with the square of wind speed while gravitational restoring torque depends on the panel weight distribution and the sine of the rotation angle, yielding a stable open equilibrium for sufficiently high winds. Friction may be tuned by decreasing the diameter of the tension band. As wind subsides, gravitational torque dominates and the panel 130 returns smoothly toward the closed orientation.

The arrangement shown is compatible with integration into multi-cartridge systems, provided that each cartridge is configured with its own rotational coupling assembly 140 and locking mechanism 150. Maintaining coplanarity in the static state and unobstructed rotation paths in the dynamic state are key to reliable operation. If adjacent landscaping or architectural features are present near the bottom edge of the panel 130, a minimum setback should be observed to prevent interference during rotation.

In some aspects, sleeves or brackets will be mounted to the posts with centerlines matched to the rotational member axis. If the sleeves incorporate bushings or bearings, the bushing material (e.g., oil-impregnated bronze SAE 841 or UHMW-PE) and press-fit tolerance should be selected to maintain the stated clearance while supporting environmental contaminants and thermal cycling.

In subsequent views, a detailed construction of the rotational coupling assembly will be shown with a cylindrical pipe member and sleeve members, including material specifications and wear components.

Figure 2:
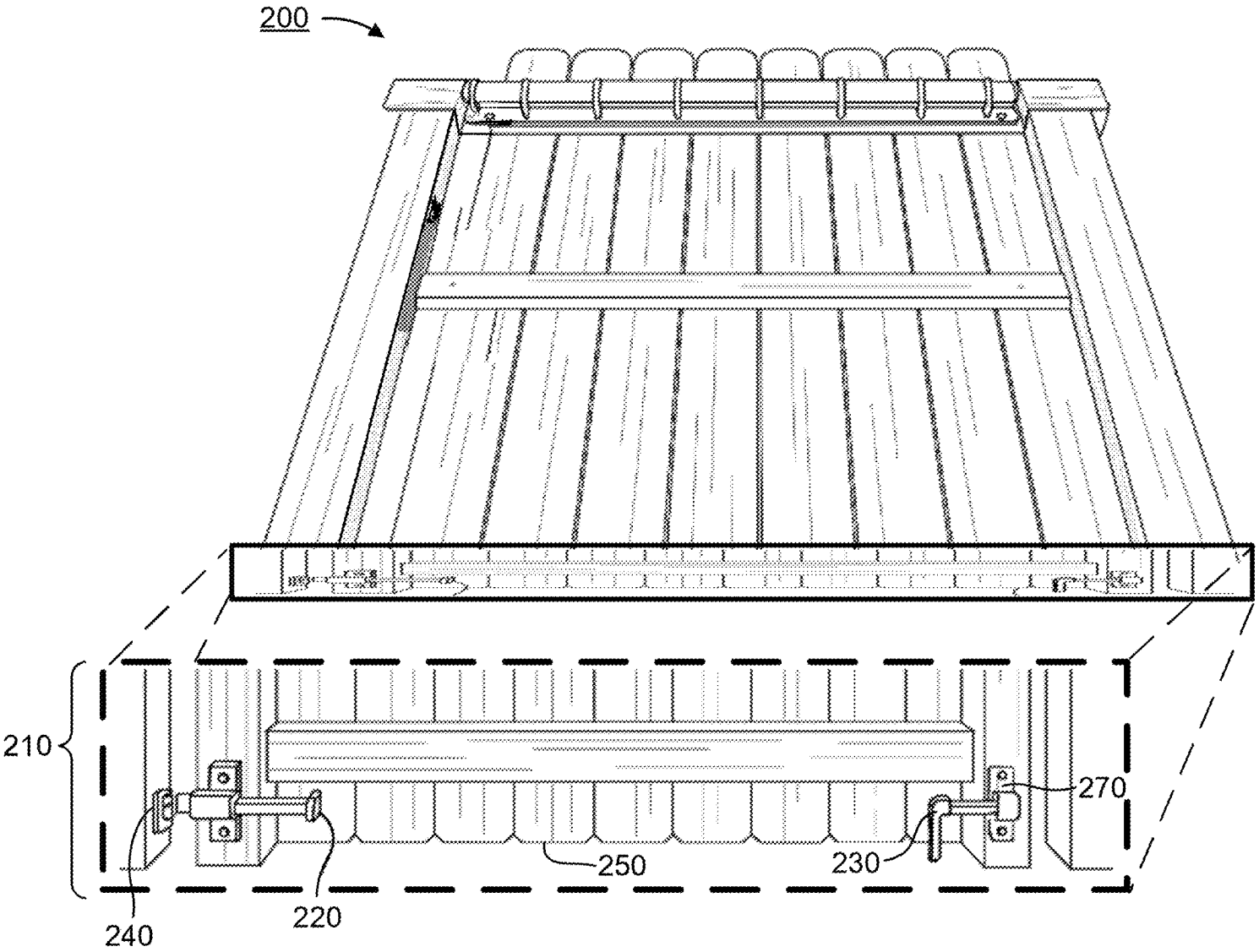
FIG. 2 depicts a closed and latched configuration illustrating a releasable locking mechanism mounted at the panel-post interface securing the panel in a fixed, non-rotational static state, according to various examples, as shown in some embodiments.

Referring to FIG. 2, which illustrates an overall environment 200 for a closed and latched configuration of a yielding fence system in the static state, a locking mechanism mounting detail 210 may be shown at the panel-to-post interface to depict how a releasable locking mechanism may be mounted and aligned for engagement. At a first side of the cartridge, a first latch assembly 220 may be mounted proximate a panel lower cross-member 250 and may engage a strike/keeper element on post 240 such that, when engaged, the panel 130 may be secured against rotation relative to the posts and retained in plane. At an opposite side, a second latch assembly 230 may duplicate the mechanism for redundancy and improved resistance to racking under incidental loads. Fasteners for lock 270 may secure each latch assembly and keeper to the respective panel and post substrates. An upper-edge rotational coupling assembly 140 may be visible to provide context for the pivot axis while the figure may emphasize locking interfaces. When the releasable locking mechanism may be disengaged, the panel 130 may permit substantially free rotation about the pivot axis in response to aerodynamic loading; in the illustrated static state, the engaged latch assembly pairs 220, 230 and keepers 240 may prevent such rotation.

Figure 9:
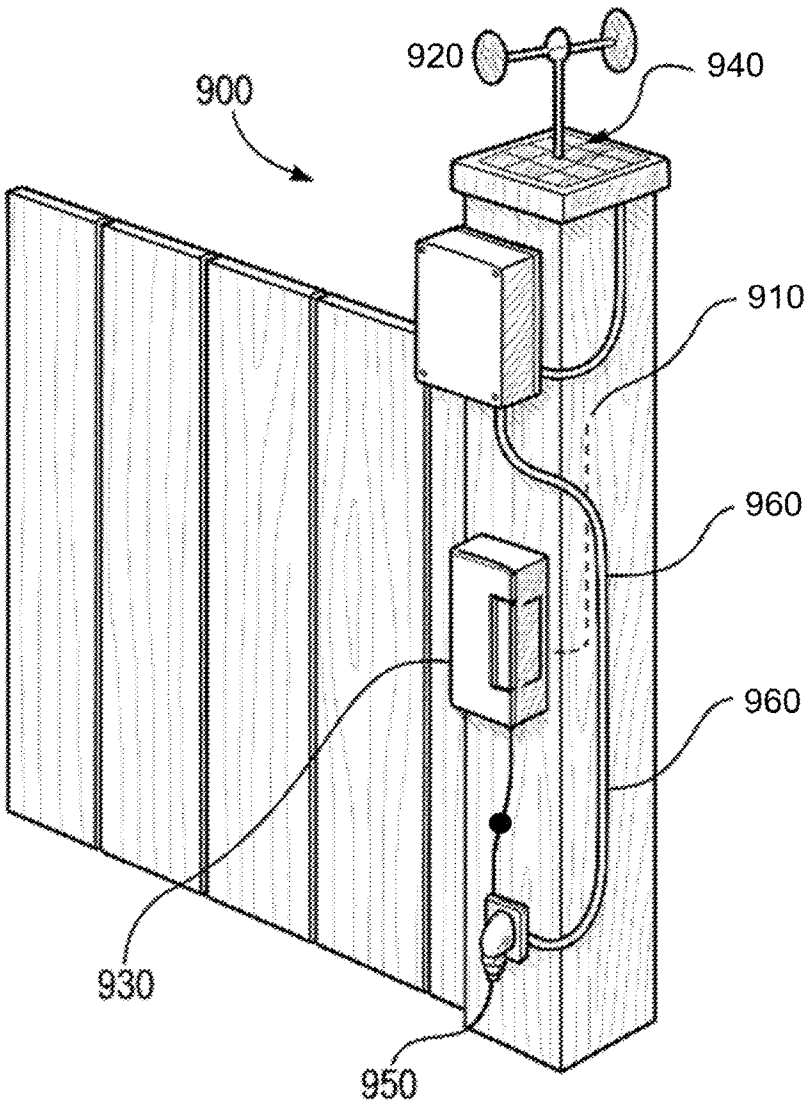
FIG. 9 depicts an electromagnetic lock and control system with an anemometer input, threshold-based actuation, and optional solar or mains power for automated lock transitions, according to various examples, as shown in some embodiments.

In the embodiment depicted by the closed and latched configuration 200, any reliable manual locking mechanism strong and with low noise as known in the art such as a galvanized 3" slide bolt, the locking mechanism (mounting detail) 210 may be implemented as a manually actuated slide-bolt subsystem with a bolt travel of approximately 1-3", a throw angle of 30-60 degrees for a lever handle, and a keeper pocket depth sufficient to resist back-driving forces induced by wind uplift and in-plane racking (as long as it's secure and not going to dislodge without user intent). The first latch assembly 220 and the second latch assembly 230 may be symmetrical components or handed variants depending on the keeper orientation of the strike/keeper element on post 240. The panel lower cross-member 250 may be selected to provide adequate screw withdrawal resistance and bearing capacity to accommodate repetitive engagement cycles in exterior conditions, and fasteners for lock 270 may include corrosion-resistant threaded fasteners with minimum tensile strength of 400-800 MPa, with thread-forming or thread-cutting profiles chosen based on the substrate species or composite density. In some embodiments, as illustrated in FIG. 9, an electromagnetic locking apparatus may occupy the same envelope as the mechanical assemblies 220, 230, wherein a solenoid-driven bolt or magnetically retained keeper is energized by the control system to effect locking, while a de-energized state permits unlocking for wind events.

The structural interface between the latch assemblies 220, 230 and the strike/keeper element on post 240 may be specified to maintain alignment tolerance across thermal expansion and moisture cycling. A recommended horizontal gap between the panel edge and the post face (any gap between the fence system panel and the posts) may be maintained within 0.75-2", with the keeper entry chamfer accommodating up to ±3 mm of misalignment. This gap may further be covered for privacy, such as with hinged privacy leaves as later disclosed and shown in FIG. 8.

When the rotational coupling assembly 140 is disposed near the upper horizontal edge of the panel, the latch assemblies 220, 230 suppress pendulous motion by constraining the panel at the lower cross-member 250. Under wind loading W (Pa) incident on the panel, the resisting shear at each engaged latch may be estimated as $V \approx (p\ A\ Cd\ e)/b$, where p denotes wind pressure, A denotes the projected area of the panel, Cd denotes a drag coefficient for a substantially planar surface, e denotes the effective eccentricity from the pivot axis to the latch elevation, and b denotes the number of engaged latches (1 or 2). For typical arrangements, engaging both the first latch assembly 220 and the second latch assembly 230 halves the per-latch shear demand and reduces twisting about the panel's vertical centerline. The keeper geometry 240 may incorporate an anti-lift lip of 2-6 mm height to prevent vertical disengagement when the panel experiences out-of-plane uplift near the lower edge.

The fasteners 270 may be installed with torque values matched to the substrate and thread form to avoid splitting or over-compression; in exemplary implementations, a torque of 2-6 N·m for small-diameter screws in wood or composite substrates may be used. Dielectric isolators (e.g., polymer washers) may be interposed between dissimilar metals to mitigate galvanic interactions in coastal environments consistent with environmental durability practices. Sealants or gaskets may be applied at keeper mounting holes to minimize water ingress and preserve the dimensional stability of the substrate over service life.

In alternative configurations, the locking mechanism (mounting detail) 210 may integrate a captive-pin keeper with spring-biased detents, a rotary cam latch with adjustable strike, or an over-center toggle with safety catch. Each of these may be installed at the same mounting datum 250, provided the engagement envelope clears the panel swing path and does not interfere with the rotational coupling assembly 140. In embodiments adopting the electromagnetic locking apparatus of FIG. 9, a low-voltage wiring harness may be routed along the inner face of the post to the keeper 240 location; the harness may be protected by conduit with a UV-stable jacket, with ingress protection at or above IP54. The control system may command lock/unlock states according to a hysteresis algorithm based on measured or forecast wind speeds, such that the engaged state is maintained until wind exceeds a first threshold and is re-established only after wind decays below a second, lower threshold.

To facilitate serviceability, slotted mounting holes on the latch backplates 220, 230 may be provided to allow micro-adjustments of ±2-3 mm after seasonal movement. The keeper 240 may include an elongated slot orthogonal to the bolt travel to permit vertical alignment with the panel lower cross-member 250, which can settle or creep over time. If the figure omits the depiction of alignment slots or adjustment screws, these features should be referenced textually and optionally included in a detail callout in a subsequent figure to avoid implying fixed-only geometry. In some embodiments, vibration damping pads may be interposed between the latch housings and the panel cross-member 250 to reduce chatter during gusts, particularly when the panel is near but not fully locked.

For multi-cartridge installations, the locking configuration shown in this single-cartridge FIG. 2 may be mirrored at alternating cartridges to manage load distribution along a fenceline. If continuous-axle multi-cartridge arrangements are presented in other figures, the local locking hardware depiction here remains valid and is applied panel-by-panel without requiring shared latching components. Where the panel is implemented as a self-contained cartridge, the latch mounts 220, 230 may be factory-installed into reinforced inserts embedded in the cartridge frame, enabling field replacement of the entire panel without rework of the post-side keeper 240.

From an ergonomic perspective, the handle geometry of a mechanical slide bolt may be selected to afford a gripping diameter of 20-35 mm or another large grip on the bolt, and an operating force under 50 N for typical users wearing gloves. The lever arm length may be chosen to reduce actuation torque while maintaining compactness to avoid snag hazards. If the drawing does not render a handle silhouette, the handle style should be identified in the specification to maintain clarity on manual actuation modalities. Where a sensorized static orientation indicator 260 is provided, the indicator may be a low-profile LED or reflective marker located at eye level on the post or within the latch housing, indicating "locked" when the engagement depth threshold is exceeded.

The interaction between the latch assemblies 220, 230 and the rotational coupling assembly 140 may be further refined by defining a lock-unlock sequence. For instance, in the example illustrated in FIG. 6, method step 650 may be performed after 640 to ensure that the panel is mechanically supported before the lock is engaged. In some embodiments, as illustrated in FIG. 9, control logic may optionally route a status signal from a local anemometer to the control system, which then inhibits unlocking if an obstruction sensor indicates the presence of an object in the swing path. This sequencing ensures the panel transitions between the static and dynamic states safely and without inducing impact loads on surrounding structures.

Material selection for the latch housings and keepers may include zinc-plated or hot-dip galvanized steel, powder-coated aluminum, or UV-stabilized polymer composites. Coatings may be specified with a minimum salt-spray resistance (ASTM B117) to meet a target service life in coastal or industrial atmospheres. The keeper 240 may include a hardened wear plate to resist bolt peening after repeated cycles; the wear plate may be replaceable without removing the entire keeper assembly.

In a forthcoming detail, a cross-sectional enlargement of the keeper pocket and bolt nose geometry will be shown to document chamfer angles, relief radii, and tolerances for debris clearance. A subsequent figure will also depict an electromagnetic lock housing with a cutaway to reveal coil placement, armature alignment, and cable strain relief features. These details complement the overview presented here and provide manufacturable guidance for both mechanical and electromechanical embodiments.

In practical operation, the closed and latched configuration is utilized during non-storm conditions to maintain privacy and security. Upon receipt of a high-wind warning, the latches may be disengaged manually or automatically to permit the panel to yield; when wind subsides, the latch engagement may be restored. Industry-specific adaptations can include higher-durability coatings for coastal deployments, tamper-resistant fasteners for public installations, and keyed overrides for property management workflows.

By clearly defining the interfaces, tolerances, and material specifications for 210, 220, 230, 240, and 250, the illustrated embodiment provides sufficient guidance to fabricate, install, and maintain the locking subsystem such that the overall system is configurable between a static state and a dynamic state with repeatable performance and serviceability.

Figure 3A:
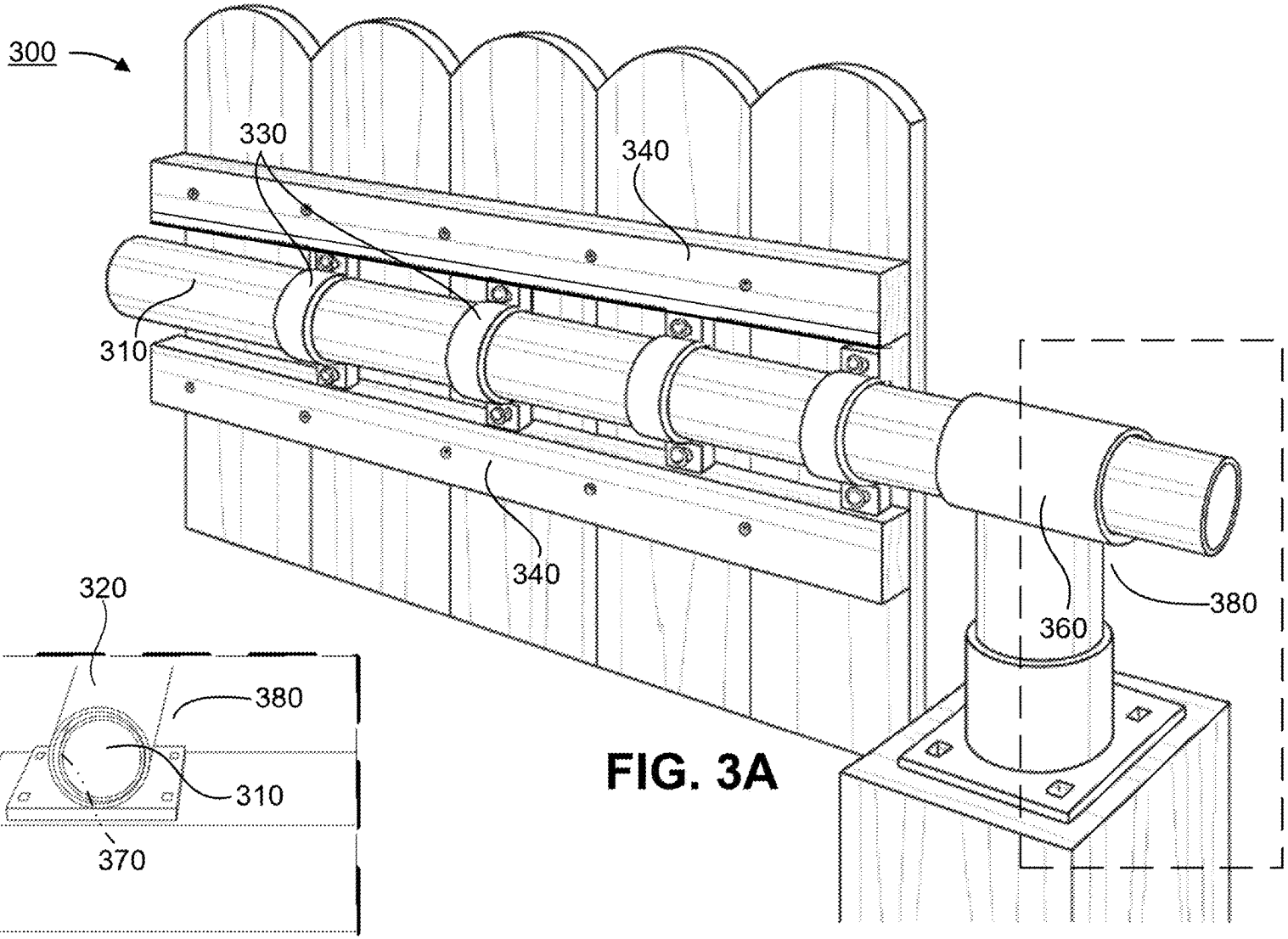
FIG. 3 depicts a rotational coupling assembly close-up including a cylindrical pipe member integrated with the panel, sleeve members on posts, tension bands to the panel frame, and an axial constraint member along the pivot axis, according to various examples, as shown in some embodiments.
Figure 3B:
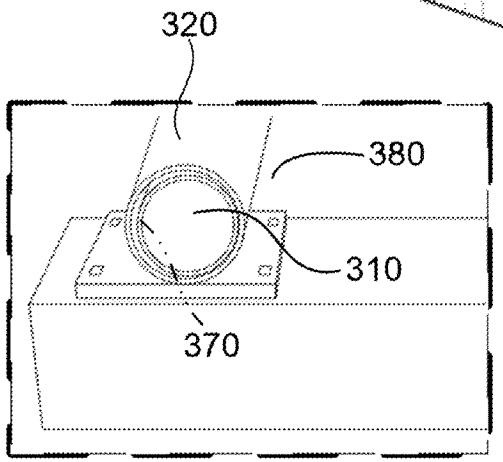

Referring to FIG. 3, which illustrates an overall environment 300 as one embodiment of a close-up of a rotational coupling assembly that may pivotally connect a panel to two structural support posts and may define a horizontal pivot axis, a singular, horizontally oriented cylindrical pipe member 310 may be integrated with the panel and may extend near and/or along an upper edge region of the panel. The cylindrical pipe member 310 may be secured to a structural frame of the panel 340 by a plurality of tension bands 330 that may wrap around the pipe 310 and may fasten to the member 340. Fasteners for bands 350 may distribute clamp loads and may maintain the pipe-to-frame interface under oscillatory wind excitation. At each end of the cylindrical pipe member 310, a sleeve member 320, may be affixed to a corresponding structural support post and may be configured to rotationally receive the end of the cylindrical pipe member 310. The pair of sleeve members 320, may journal the pipe 310 and may set the pivot axis, enabling the panel to rotate when a releasable locking mechanism may be disengaged. The assembled components—cylindrical pipe member 310 and sleeve members 320, —may include a material selection such as galvanized steel 370 for corrosion resistance in outdoor environments. An axial constraint member 360 may be disposed on the cylindrical pipe member 310 adjacent a sleeve interface and may be configured to prevent horizontal translation of the panel relative to the two support posts, maintaining a stable cartridge width while allowing rotation about the pivot axis. The structural frame of the panel 340 may provide a load path between the tension bands 330 and the surface panel material, supporting pipe torque and panel weight.

In some implementations, the cylindrical pipe member 310 may be a welded or seamless round tube having an outside diameter in a range of approximately 1.25-2.00 inches with a wall thickness in a range of approximately 0.083-0.154 inches, selected to satisfy bending and torsion limits derived from panel mass and design wind loads. The sleeve members 320, may present an inside diameter exceeding the pipe outside diameter by a diametral clearance in a range of approximately 0.005-0.040 inches to achieve substantially free rotation while mitigating chatter. A surface finish of 32-125 microinch Ra on the pipe bearing region can reduce friction; the bearing interfaces may optionally be honed or fitted with thin-wall bushings consistent with the support embodiments. Where corrosion exposure is severe, the pipe member 310 and sleeve members 320, may be fabricated from galvanized steel having a protective zinc layer of at least G90 specification, with welds re-galvanized or coated post-fabrication.

The axial constraint member 360 may be implemented as a split-ring collar with a through-bore concentric to the pipe axis and a clamp fastener, such as a socket-head cap screw, torqued to a value sufficient to withstand axial thrust derived from asymmetric panel loading and thermal expansion. In some embodiments, two collars 360 may be positioned inboard of respective sleeves 320, to symmetrically bound the panel's axial position; in other embodiments, a single collar 360 may be used in combination with a fixed stop shoulder integrated into one sleeve. If thermal growth of the pipe 310 is significant for long spans, collar placement and sleeve stop features should include allowances that prevent binding under maximum temperature differential.

The tension bands 330 may be formed as strap clamps or hanger clamps that wrap at least 180 degrees around the pipe 310 and bolt to the structural member 340 using corrosion-resistant fasteners. Typical spacing between adjacent bands 330 may be in a range of approximately 6-16 inches to distribute loads into the member 340 while limiting local crushing of wood fibers (when the frame is wooden) or local yielding (when metallic). Fasteners 350 may be threaded into pilot holes or pass through the member 340 with nuts and washers; in either case, torque values should be specified to prevent loosening under vibration while avoiding over-compression of the frame substrate.

From a mechanics standpoint, wind force on the panel creates a distributed pressure that yields a net moment about the pivot axis 380. The pipe 310 experiences combined torsion and shear; the maximum shear stress $\tau_{max}$ may be approximated by $T*r/J$ for a thin-walled tube, where T is the torque computed from wind load times lever arm, r is the mean radius, and J is the polar moment of inertia. The sleeve members 320, provide radial support and react shear into the posts; the bearing pressure between the pipe 310 and sleeves 320, should remain below allowable limits for the selected materials and lubrication regime. In embodiments employing bushings, a PV limit (pressure-velocity product) rating may be met or exceeded with appropriate selection of polymer or sintered bronze materials.

Alignment of the axis defined by sleeves 320, is facilitated by a field jig or temporary alignment bar inserted through the sleeves prior to fixing them to the posts. The panel 340 with pipe 310 and bands 330 may then be lifted into place, and collar 360 secured after centering. If the posts are not coplanar or exhibit vertical misalignment, shim packs or adjustable mounting slots on the sleeves 320, may be required; final adjustment should be performed with the locking mechanism disengaged to verify substantially free rotation without interference.

Alternative configurations of the rotational coupling assembly include a bottom-edge placement (see FIG. 7), where identical pipe 310, sleeves 320, bands 330, and collar 360 are inverted to establish the pivot axis near the panel's bottom, allowing the panel to rotate toward a substantially horizontal orientation proximate to the substrate. In multi-cartridge deployments, the pipe member 310 may be coupled across cartridges via internal couplers or may be segmented with each cartridge employing independent sleeve pairs 320; both arrangements are encompassed by the present disclosure provided that each panel remains pivotally connected and axially constrained.

Lubrication strategies may include a lubrication port integrated into each sleeve 320, with a check valve to receive grease and exclude contaminants. Seasonal maintenance intervals can be specified to replenish lubricant and to retorque fasteners 350 and the collar 360. Galvanic isolation (e.g., polymer washers or sleeves) may be placed between dissimilar metals at band-to-frame and sleeve-to-fastener interfaces to mitigate corrosion in coastal environments. Preferably, however, all forces on 1 panel to be absorbed by its components alone, not added to the supports of another panel.

Electrical or control subsystems are not required to practice the mechanical rotational coupling assembly; however, in embodiments employing an electromagnetic locking apparatus, wiring may be routed clear of the sweep of band edges 330 and away from the bearing interfaces of sleeves 320. Cable management features such as grommeted pass-throughs in the member 340 or clips located on non-rotating structures should be used to prevent abrasion during repeated oscillations of the panel.

For manufacturing repeatability, the member 340 may include a machined or routed seat conforming to the curvature of the pipe 310 along a limited arc to enhance stability. Adhesive bonding agents can be used in addition to fasteners to distribute stress, provided that service disassembly of the bands 330 remains possible for repair or replacement. Where adhesives are used, cure schedules and environmental conditions should be controlled to achieve full mechanical properties prior to load application.

From a system-level perspective, the pipe 310 and sleeves 320, define the kinematic pair that enables the transition between static and dynamic states. The axial constraint member 360 ensures that kinematic freedom is limited to rotation while axial motion is substantially prevented, preserving alignment with adjacent cartridges and maintaining panel-to-post gap targets that support privacy. In service of privacy, a cover is made of the gaps between the posts 110 and the panel, 130. This 1.5 inch gap is covered at each pair of posts by a pair of leaves which when open cover the gaps and when closed are held out of the path of the swinging panel. The rotational clearance selected for the pipe-sleeve interface should account for manufacturing tolerances, coating thickness variation due to galvanization, and field contamination, while ensuring that the friction torque remains below a specified threshold so that wind-induced aerodynamic loading can overcome static friction in the dynamic state.

In some embodiments, as later illustrated in FIG. 6, method step 630 optionally verifies concentricity of the sleeves 320, using a gauge mandrel prior to installing the panel-mounted pipe 310, and method step 650 includes a functional rotation test to confirm that the panel rotates freely about the pivot axis 380 over a prescribed angular range without fouling. For instance, in the example illustrated in FIG. 6, method step 640 details mounting the panel by inserting the pipe 310 into sleeves 320, while the collar 360 remains loose, followed by centering and collar tightening to establish an axial stop condition.

In a subsequent electrical/control embodiment (see later-described FIG. 9), a control system 910 may monitor wind speed via an anemometer 920 and energize/de-energize an electromagnetic locking apparatus, while the mechanical rotational coupling assembly of FIG. 3 remains unchanged; this decoupling between control and mechanical pivot enables modular upgrades and serviceability.

Quality assurance may include non-destructive checks such as dye penetrant inspection of pipe-to-band contact regions for early detection of fretting, and torque audit of the collar 360 fastener after a defined number of wind events. Environmental testing can include cyclic salt-fog exposure to verify coating durability of the galvanized steel 370 and functional rotation after test intervals.

Figures 4A, 4B, 4C, 4D:
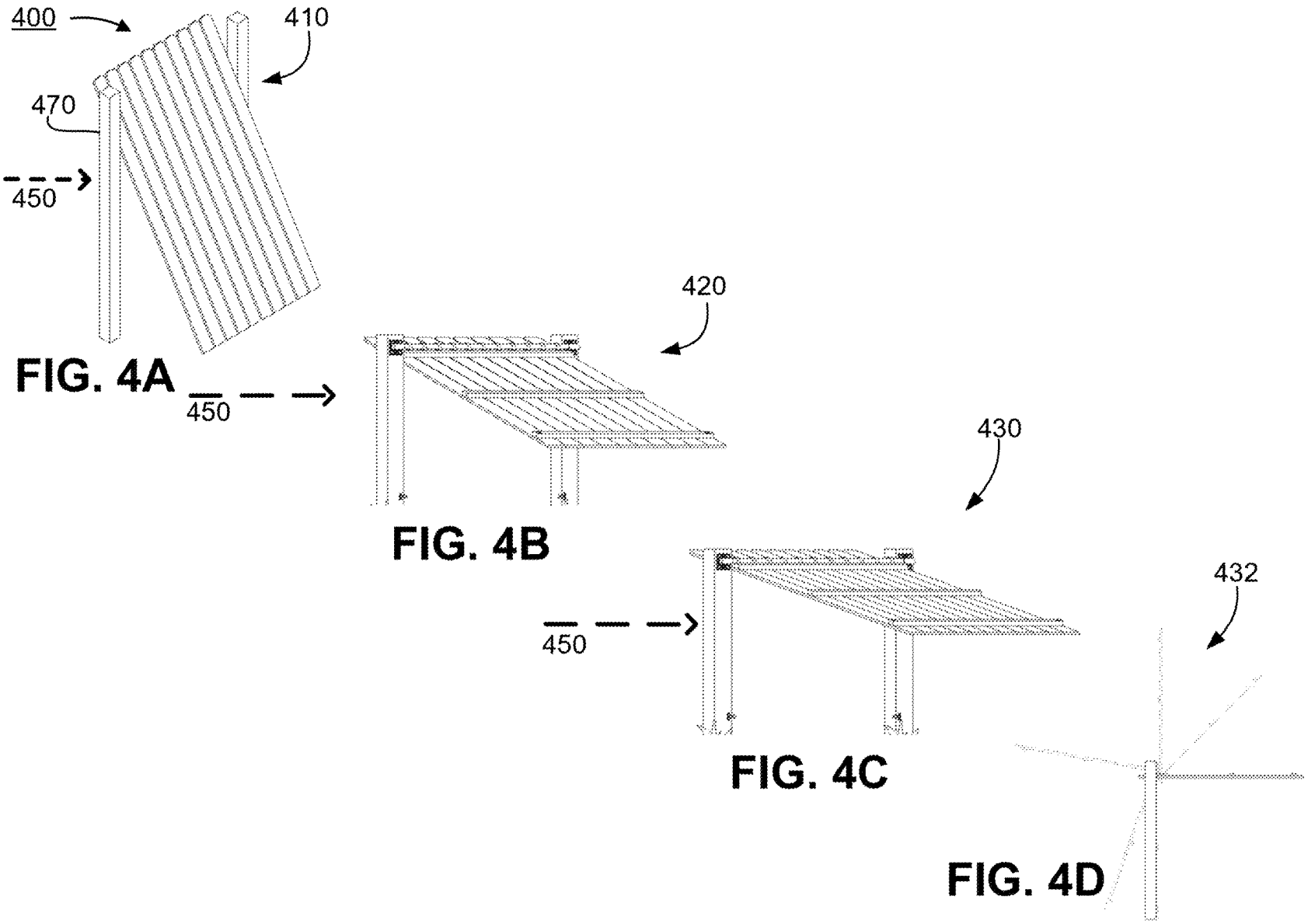
FIG. 4 depicts representative panel angular orientations demonstrating static and dynamic states for upper-edge and bottom-edge pivot placements with wind-induced rotation about the pivot axis, according to various examples, as shown in some embodiments.

Referring to FIG. 4, which illustrates an overall environment 400 showing angular orientations of a yielding fence system configurable between a static state and a dynamic state, a panel may be shown at three discrete orientations relative to a pair of structural support posts to depict response about a pivot axis under wind loading. A near-vertical panel position 410 may represent a fence-like, privacy orientation corresponding to the static state when the panel may be secured in a fixed, non-rotational orientation by a releasable locking mechanism. An intermediate angle position 420 may show the panel partially open in a dynamic state, illustrating that, when unlocked, the panel may permit substantially free rotation about the pivot axis in response to aerodynamic loading. A horizontal position 430 may demonstrate a dynamic state proximate to horizontal, consistent with embodiments where a bottom-edge rotational coupling may allow the panel to rotate to a substantially horizontal orientation at a substrate. An angle position indicator may illustrate that the panel may be temporarily retained at various angles, without requiring a particular hardware type. Wind direction arrows 450 may indicate aerodynamic loading vectors that may drive rotation from the static state toward more open orientations. An upper pivot location indicator may mark an embodiment with the rotational coupling assembly disposed near and/or along an upper horizontal edge such that, in dynamic conditions, the panel may rotate in a pendulous motion from the bottom edge. A bottom pivot location indicator 710 may mark an alternative embodiment with the rotational coupling assembly disposed near a bottom horizontal edge, allowing rotation toward a substantially horizontal orientation proximate to the substrate. Static/dynamic state callouts 480 may distinguish when the panel may be locked versus free to rotate.

In some embodiments, the static state may be characterized by a net zero rotational velocity of the panel and a lock engagement condition sensor that outputs a latched status, whereas the dynamic state may be characterized by the absence of a mechanical constraint and a panel angular displacement rate exceeding a configurable threshold; for example, it may be set between 2-10 deg/s to discriminate true wind-induced rotation from incidental vibration. The angular positions illustrated—near-vertical panel position 410, intermediate angle position 420, and horizontal position 430—may be represented as absolute angles θ measured about the pivot axis, where θ=0° corresponds to the fence-like orientation of 410 and θ increases toward 430. The intermediate state 420 may be depicted at θ≈25-45°, while the horizontal state 430 may reach θ≈85-95° allowing for manufacturing tolerances and ground clearance. The angle indexing/locking depiction 440 may be implemented by a detent geometry or multi-position latch slots that discretize θ into stable equilibria; however, the depiction remains hardware-neutral so as not to limit embodiments.

With respect to aerodynamic loading, wind direction arrows 450 schematically represent the resultant pressure on the projected area Ap of the panel, which may be estimated by q=0.00256 V^2 psf (ASCE-7 style stagnation pressure) and Fw=Cd q Ap, where Cd is a drag coefficient possibly depending on wood or vinyl surface selected according to panel smoothness, porosity, and/or edge effects. For example, a slatted panel may have Cd between approximately 0.7 and 1.1 depending on picket spacing, while a solid sheet embodiment may have Cd between approximately 1.1 and 1.3. The tipping moment about the pivot axis is therefore Mw=Fw rcp, where rcp is the moment arm from the pivot axis to the panel's center of pressure; for an upper pivot (upper pivot location indicator), rcp is measured downward from the axis, whereas for a bottom pivot (bottom pivot location indicator 470), rcp is measured upward. The pendulous behavior associated with the upper pivot arrangement tends to promote self-closing under gravity when aerodynamic loading subsides, while the bottom pivot arrangement may require greater user input or a biasing element to return the panel from open to closed, particularly if θ approaches horizontal. In some embodiments, windmill 432 may be a state in which the wind blows the fence panel/cartridge around over the top of the pipe/axis and/or uses a power harvesting electromechanical device to turn the cartridge into a power station. If the pipe is in the center vertically, it can enable easier rotation about the axis to create power generation, and some embodiments thusly mount the cartridge to the axis/pipe closer to the center region of the cartridge.

The upper pivot location indicator 460 corresponds to embodiments where a rotational coupling assembly is disposed near and/or along an upper horizontal edge, producing a restoring gravitational torque Mr=m g rcm sin θ that scales with panel mass m, gravitational acceleration g, and the vertical distance rcm from the pivot axis to the panel's center of mass. For the bottom pivot location 470, gravitational torque may oppose return to closed orientation near horizontal and may be augmented by a damping or biasing subsystem in other figures. The balance condition that initiates rotation may be approximated by Mw≥Fr+Mstiction, where Fr is friction torque at the pivot and Mstiction represents static friction and any latching preload. For manufacturability, Fr may be targeted below 1-3% of the peak wind moment within the design event to ensure repeatable yielding while avoiding nuisance motion at low winds; surface finishes, bushing selection, and lubrication regimes contribute directly to this target.

In some embodiments, the angle indexing/locking depiction 440 may represent a user-selectable stow mode for non-storm conditions, positioning the panel at an intermediate angle 420 to function as a privacy or sun-shade element while reducing steady-state wind loads. In such cases, the static/dynamic state callouts 480 may further differentiate between a "latched-open" static mode and a "free-swing" dynamic mode, the former restricting rotation at a chosen θ and the latter allowing free rotation past 420 toward 430 when wind direction arrows 450 align with the panel normal. If the indexing is provided by removable pins placed at the posts, the clearance tolerances at the pin holes and the allowable pin shear loads should be specified to avoid wear-induced looseness; alternately, a toothed sector and pawl may be employed, but tooth pressure angle and material hardness should be confirmed for outdoor duty cycles.

In operation, as wind speed increases, dynamic pressure produces a nonlinear increase in Mw, and the panel transitions from 410 to 420 once Mw exceeds the aggregate resisting torques. Hysteresis in the return path may be provided intentionally such that the panel remains at 420 until wind speed decreases below a second, lower threshold, thereby reducing chattering at threshold conditions. In deployments with an automated control system—as referenced elsewhere—unlocking may be triggered in anticipation of a storm, after which the mechanics depicted in FIG. 4 govern motion. If mixed pivot types are installed in adjacent cartridges, wind-induced flow phenomena such as vortex shedding and wake interference could occur; spacing between cartridges and staggered pivot selection may be used to minimize synchronous motion.

The depiction of the horizontal position 430 is intended to be read as proximate to the substrate and not necessarily in contact therewith; a minimum ground clearance (e.g., 25-100 mm) may be prescribed to accommodate uneven terrain and thermal expansion. In bottom pivot embodiments, soft stops may be used near 430 to manage impact energy.

Materials used for the panel surface alter both Cd and mass distribution; wood pickets and composite panels exhibit different rcm and rcp, which should be considered in selecting the pivot type.

From an installation and maintenance perspective, the user may select either the upper pivot arrangement (indicator 460) or bottom pivot arrangement (indicator 470) based on site wind roses and desired behavior. Angle references may be embossed or printed on the posts to provide visual confirmation of θ in the field, and the static/dynamic state callouts 480 may be implemented as color markings on the lock lever or as indicator LEDs in embodiments integrated with a control system. If LEDs are used, ingress protection (e.g., IP65 or higher) and UV-stable lenses should be specified; wiring routes should be isolated from pinch points across the swing arc.

Figure 6:
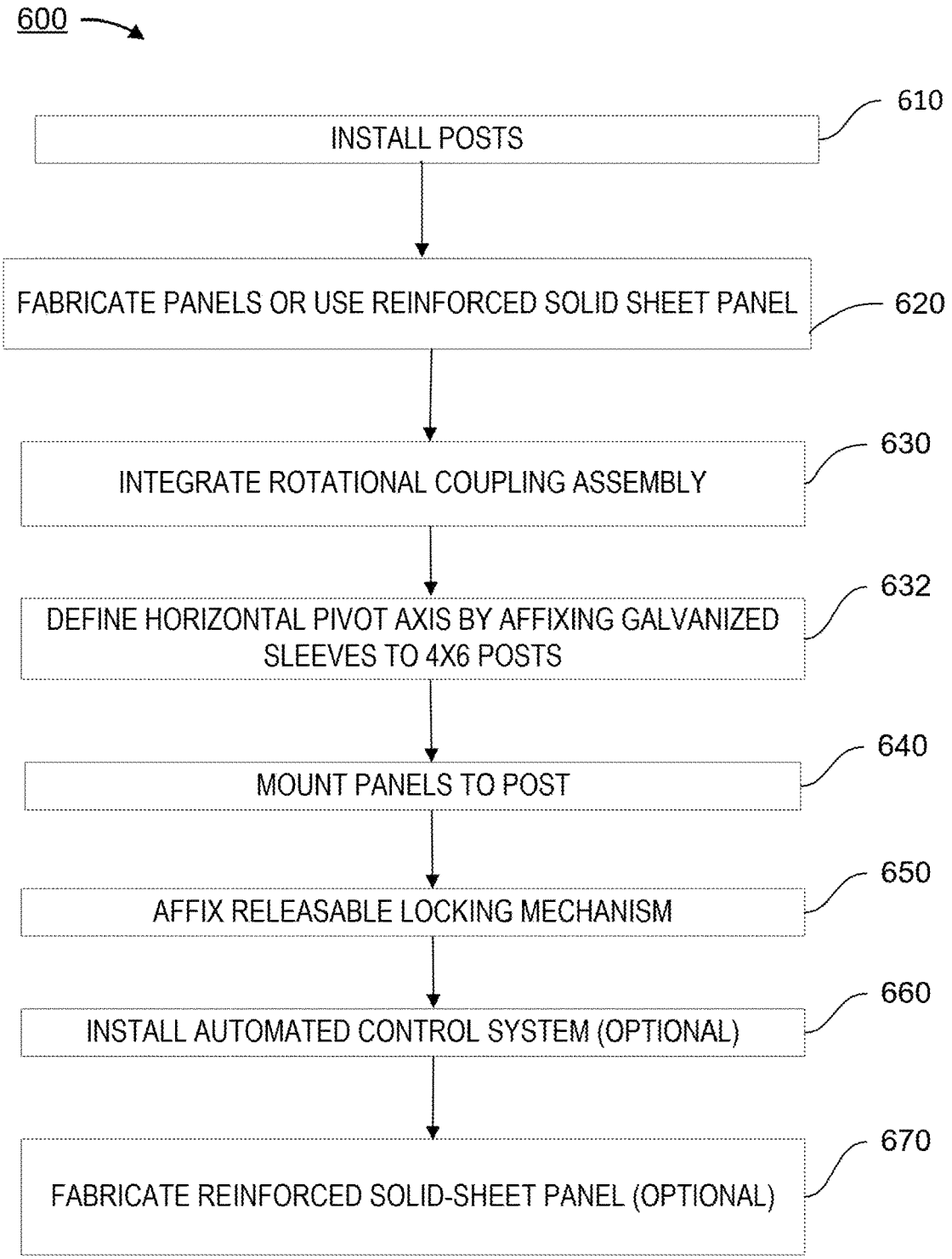
FIG. 6 depicts a manufacturing method flow including installing posts, fabricating panels, integrating a rotational coupling assembly to define a horizontal pivot axis, mounting panels, and affixing a releasable locking mechanism, according to various examples, as shown in some embodiments.

In some embodiments, as illustrated in FIG. 6, method steps for installing the rotational coupling and locks optionally route through a quality verification checkpoint in which measured Fr and proof-load Mw are recorded against a commissioning checklist. For instance, in the example illustrated in FIG. 6, a torque application procedure may be applied to fasteners at the coupling and to indexing hardware, and a low-angle displacement test may verify smooth initiation of motion near $\theta \approx 10\text{-}15°$. Upon completion, the panel may be stowed at 410 and locked, with the automated system (if present) configured to unlock upon receipt of threshold wind data referenced in other figures.

Figure 5:
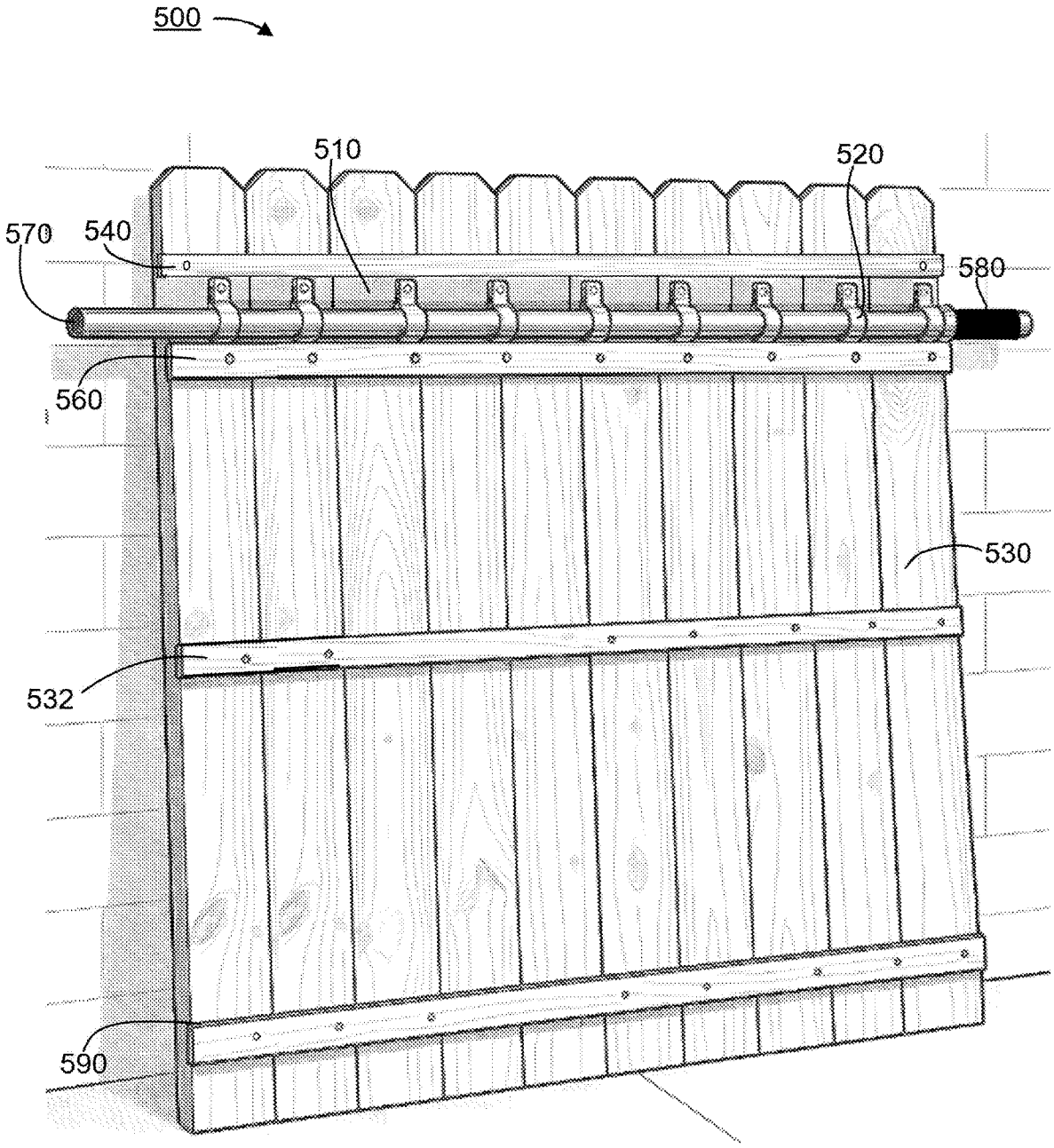
FIG. 5 depicts an inside face of a fabricated panel subassembly with a surface panel material, rigid frame, a member, tension-band clamps to a cylindrical rotational member, and axial collars for lateral constraint, according to various examples, as shown in some embodiments.

Referring to FIG. 5, which illustrates an overall environment 500 as a fabricated panel subassembly prepared for installation into a yielding fence system, a panel body formed by a surface panel material 530 may be secured to a rigid frame including a top rail 540 and a lower rail 590. An overhead backer member 540 may be fastened along an upper region of the panel body and may function as a continuous load-spreading element above tension band hardware. A tension band variant (hanger clamp) 520 may be shown at intervals along a length, each clamp encircling a cylindrical rotational member and fastening to the backer member 510 so as to secure the rotational member to the panel's structural framework. In certain aspects, the clamps 520 may embody a plurality of tension bands that may secure a cylindrical pipe member to a structural frame of the panel, providing distributed attachment that may resist torsion (reducing torsional stress on the rotational coupling assembly) and uplift under wind. At each lateral extremity of the rotational member, a rotational member end extension 570 may project beyond panel width to form opposing ends that may be received by sleeves on posts in service. Axial constraint collars 580 may be disposed inboard of the ends to limit lateral movement once the panel may be mounted, aligning with an axial constraint function recited elsewhere. A row of structural support posts 532 may be indicated schematically to contextualize cartridge installation; a sleeve member bracket on post 522 may correspond to a sleeve that journals the rotational member ends when installed. The lower rail 590 may provide a stiff datum for lower-edge hardware and may contribute to in-plane stiffness when the panel may be locked in the static state. The arrangement of 510 and 520 may establish a load path from the rotational member into the panel frame while preserving free rotation about a pivot axis when the panel may be unlocked.

In some embodiments, the rotational member associated with 520 and 570 is a cylindrical rotational member having an outside diameter in the range of 25-60 mm, with wall thickness selected to maintain bending deflection under design wind load below L/500 across the clear span between sleeve supports; for example, a 38 mm OD, 3.2 mm wall galvanized steel tube per ASTM A653/A653M (e.g., G90) may be used to balance mass and stiffness. The cylindrical rotational member may be cut to a length that exceeds the panel width by an extension length at each lateral side (e.g., 30-75 mm per side) sufficient to establish the opposing ends and provide engagement length for sleeve reception and axial collar seating. Radial clearance between the rotational member and the receiving sleeve (not shown in FIG. 5) may be selected between 0.10-0.60 mm diametral to achieve a free-rotating fit while accommodating coating thickness and thermal expansion.

The tension band variant 520 may be provided as a one or two-piece saddle clamp forming a wrap angle of at least 210 degrees around the cylindrical rotational member to distribute contact pressure and limit localized ovalization. Each 520 may include a pair of fasteners oriented parallel or transverse to the panel plane; exemplary fasteners include M6-M10 machine bolts (ISO 4017) or #10⅜ in. UNC bolts per SAE J429 Grade 5 or stainless steel A 2-70, with applied torque in the range of 6-28 N·m depending on fastener size and substrate. Where 520 bears directly on 510, a compressible isolation pad (e.g., EPDM, 60-70 Shore A, 1-2 mm thickness) may be interposed to mitigate fretting and galvanic coupling with dissimilar metals; dielectric isolators consistent with the corrosion isolation practices described elsewhere may be used.

Carrier/backer member 510 may be a wooden picket, a continuous steel flat bar (e.g., 40-75 mm width, 3-6 mm thickness) or an extruded aluminum section (e.g., 6061-T6, anodized per MIL-A-8625 Type II) configured to receive the clamp fasteners of 520 without crushing the underlying surface panel material 530. In picket-based embodiments, the 510 may be fastened to the top rail 540 or to picket crowns using threaded fasteners at a spacing not to exceed 250 mm centers; for sheet-based embodiments, the 510 may be fastened through a reinforced hem or to an internal reinforcement rib to maintain planar stiffness and prevent oil-canning during oscillatory loading.

Surface panel material 530 may be implemented as individual wood pickets, composite boards, or a solid sheet of vinyl internally reinforced with a rigid structural core (e.g., glass-reinforced polymer honeycomb core having a compressive modulus of 30-90 MPa). When 530 is a solid sheet, thermal movement slots or expansion joints may be provided at lateral edges to avoid buckling; when 530 is discrete pickets, the fastener pattern and pilot hole sizing may be selected to avoid splitting and to maintain serviceability by allowing individual replacement per method claim 15.

Top rail 540 and lower rail 590 cooperate to define a rigid frame for the panel body and to distribute shear and bending loads into 520. The top rail 540 may be joined to 510 using through-bolts with large-diameter washers (e.g., 25-40 mm OD) to distribute bearing loads on wood fibers. The bottom rail 590 may be configured to receive a lower latch or keeper in other figures and to act as a stiffener reducing racking. The distance between 540 and 590, and the aspect ratio of the panel, may be tuned to control the pendulous moment of inertia about the pivot axis to achieve a desired natural frequency outside of common vortex shedding bands for the installed site wind regime.

Rotational member end extension 570 is shown projecting beyond the pickets and any panel side stiles to define connection interfaces for pivotal mounting. The axial constraint collars 580 are disposed inboard of the ends by a clearance offset (e.g., 5-15 mm from the sleeve face when installed) sufficient to accommodate assembly tolerances, thermal expansion, and end-play under wind-induced oscillation. The collars may be split-ring type with a clamping fastener, configured to develop at least 1.5× the maximum anticipated axial inertial load during gust events without slip. If the collars 580 are specified as set-screw collars rather than split clamps, an anti-marring insert or flats on the rotational member should be defined to avoid burr formation and stress risers.

Finite element or closed-form estimation may be used to select the spacing of 520. For example, panel wind pressure qp may be taken as qp=0.00256·V^2 psf (V in mph) and multiplied by a drag coefficient (Cd 0.7-1.2 depending on porosity). The resulting line load on 510 is resolved into clamp reactions at 520, and clamp spacing is chosen such that clamp shear and bearing stresses remain below allowable limits with safety factors such as 2.0 for ultimate and 1.5 for serviceability. The bending moment in the rotational member between sleeves is limited by selecting tube diameter and wall thickness to achieve a deflection at midspan less than 3-6 mm under design wind, thereby maintaining consistent sleeve fit and minimizing wear.

Manufacturing of the subassembly may be performed as follows: 570 is cut to length and deburred; hole patterns are drilled or punched to match tension bands 520's fastener locations; 520 tension bands are pre-assembled loosely to 510; the cylindrical rotational member is nested in 520; the assembly is set onto the panel at a datum line relative to 540; fasteners are installed to match tension bands 520 fastener locations and may meet torque requirements as reasonably required; collars 580 are slid onto the rotational member but left unseated pending installation to posts. Quality control may verify clamp torque, rotational freedom (e.g., panel rotates freely with torque <1.0 N·m at the pivot axis), and dimensional conformance of end extension 570 relative to the panel side edges.

The row of structural support posts 532 is shown schematically to establish the installation context.

In some embodiments, the subassembly includes provision for routing of control conductors associated with an electromagnetic locking apparatus shown elsewhere; for example, a small-diameter conduit or grommeted passthrough near 540 may be provided to guide wiring away from 520 to avoid chafe and to maintain isolation from moving interfaces. If an onboard sensor or reed switch is used to confirm panel closed status for the control system, the sensor mounting boss location and airgap should be specified, and the magnet placement on the frame should be identified to avoid magnetic interference with collars 580.

Alternative configurations may substitute nonferrous rotational members (e.g., anodized aluminum) to reduce mass and pivot friction; in such cases, 520 tension bands may use polymer wear sleeves to prevent galling. Composite rotational members (e.g., filament-wound carbon/epoxy) may be used in corrosive environments, provided sleeve materials and clamp friction are adjusted (e.g., increased wrap angle, textured liners) to prevent slip and fiber damage. Carrier/backer member 510 may be segmented into multiple shorter lengths joined by fishplates to facilitate packaging and to accommodate thermal movement; segmentation joints may be staggered relative to 520 to avoid stiffness discontinuities.

Field adjustability may be provided by elongated slots in 510 or 520 base plates, allowing minor vertical adjustment of the rotational member axis to reconcile post misalignment. The collars 580 may be temporarily loosened to shift the panel laterally during hanging, then re-tightened to lock axial position; a thin shim washer may be inserted between the sleeve and collar to fine-tune end-play.

Environmental durability may be enhanced by hot-dip galvanization of steel components after fabrication, followed by seal coating of cut edges. Where stainless steel fasteners are used with galvanized assemblies, dielectric washers and anti-seize compounds compatible with zinc are recommended to reduce galvanic currents and cold welding. In coastal exposures, periodic maintenance intervals (e.g., annual visual inspection; 2-3 year re-lubrication if bushings with grease ports are used) may be specified.

Installation workflow in context with the method flow is straightforward. In some embodiments, as illustrated in FIG. 6, method steps 610-670 will be applied to fabricate panels or use reinforced solid sheet panel 620, integrate the rotational coupling assembly 630 with substep 632, mount panels to posts 640, and affix locking mechanisms 650, with optional control system installation 660 and solid-sheet fabrication 670 applicable to this subassembly. For instance, in the example illustrated in FIG. 6, the pre-assembled FIG. 5 subassembly is lifted to post-mounted sleeves, the end extensions 570 are guided into the sleeves, and collars 580 are then advanced to their final inboard positions and secured.

Industrial applicability includes residential, commercial, and critical infrastructure perimeters where wind resilience and rapid post-storm recovery are desired, as well as temporary perimeter systems that benefit from modular replacement of damaged surface panel material 530 without dismounting the rotational member. The subassembly is compatible with both manually actuated and electromagnetic locking mechanisms by providing a stable upper hinge datum and adequate stiffness to limit chatter during gusting. Junctions of fence where, for example a north-south fence meets an east-west-running fence, one panel that does not yield is preferrably placed adjacent to a yielding panel to avoid collision under multidirectional aerodynamic loads.

Referring to FIG. 6, which illustrates an overall environment 600 as a method flowchart for manufacturing a hurricane-resistant, yielding fence system, the sequence may define operations to install structural supports, fabricate panel assemblies, integrate a rotational coupling assembly that may define a horizontal pivot axis, mount the panels between posts, and equip the panels with a releasable locking mechanism. As shown in step 610, the method 600 may include installing a plurality of structural support posts in a substrate. As shown in step 620, the method 600 may include fabricating panels, which may be constructed as panel cartridges with a surface panel material attached to a rigid frame. As shown in step 630, the method 600 may include integrating a rotational coupling assembly with each panel to enable pivotal connection between the panel and two support posts. As shown in substep 632, the method 600 may include defining a horizontal pivot axis by affixing a singular cylindrical pipe to a rigid perimeter frame of the panel via a plurality of tension bands. As shown in step 640, the method 600 may include mounting each panel between a pair of the structural support posts by pivotally connecting the rotational coupling assembly to the pair of structural support posts. As shown in step 650, the method 600 may include affixing a releasable locking mechanism configured to selectively prevent and permit rotation of each panel. As shown in optional step 660, the method 600 may include installing a control system configured to actuate an electromagnetic locking apparatus based on meteorological data that may be received from a local anemometer. As shown in optional step 670, the method 600 may include fabricating a panel using a solid sheet of vinyl internally reinforced with a rigid structural core as a wind-facing surface material.

To provide implementation-level clarity for the method flow shown in FIG. 6 overall environment 600, additional exemplary specifications are provided for each operation. In the install structural support posts step 610, augered bores may be formed to a depth sufficient to resist overturning moment per a site-specific design wind speed, with an embedment-to-exposed-height ratio chosen to satisfy a minimum factor of safety under lateral load. In some embodiments, a cementitious backfill of nominal 3,000-4,000 psi compressive strength at 28 days may be used, placed with a crown to shed surface water; coarse aggregate size and water-to-cement ratio may be selected to reduce shrinkage cracking. A verticality tolerance of ±0.5° and a post-centerline spacing tolerance of ±6 mm may be specified to ensure sleeve alignment during later steps. Where frost heave is a concern, an enlarged bell at the base or a formed pedestal may be incorporated to increase uplift resistance.

In the fabricate panels step 620, panels are constructed as panel cartridges with a rigid frame, such as top and bottom rails joined to pickets via mechanical fasteners and/or adhesives compatible with the selected substrate. Surface panel material 530 may be implemented using individual pickets fastened with corrosion-resistant threaded deck screws (e.g., 305 or 316 stainless or hot-dipped galvanized), driven to a specified torque to avoid over-penetration and fiber crushing. A nominal gap uniformity tolerance between pickets of ±2 mm may be held to control airflow and privacy. For solid-sheet embodiments, the reinforced sheet may be cut to width less than 5 feet to control torsional loads and reduce the effective sail area.

In the integrate rotational coupling assembly step 630, the panel is prepared to accept a rotational member. A define horizontal pivot axis substep 632 may affix a singular cylindrical pipe to the frame via a plurality of tension bands 330 (as shown in other figures) at a calculated spacing. Band spacing S may be determined using a simplified distributed load model where the panel weight W and a portion of wind-induced moment M are resisted by N clamps, such that clamp force $Fc \approx (W \cdot g/N) + (M/(N \cdot r))$, where r is the lever arm from the pivot axis to the panel center of pressure. To reduce wear, low-friction liners may be interposed beneath tension bands/saddles. Clearances between the cylindrical pipe and each sleeve may be set in the range of H7/g6 fits for steel-on-steel bushings, or with polymer bushings sized for a running clearance of 0.05-0.20 mm, depending on diameter and expected thermal expansion.

The mount panels to posts step 640 may include a temporary alignment jig to hold the panel plumb while the pipe ends are introduced into the sleeve members affixed to the structural support posts installed at step 610. Sleeve centerlines are to be held colinear within ±1 mm across the cartridge to avoid binding. A field verification procedure may be employed in which the unlatching moment required to initiate rotation is measured and recorded, with an acceptance criterion that the measured moment is below a defined threshold to confirm "substantially free rotation." Axial constraint members (collars) may be loosely installed at this stage and final-locked after thermal expansion checks.

In the affix releasable locking mechanism step 650, the locking mechanism is mounted at a height and location that minimize torsional load about the pivot axis in the static state while maintaining ergonomic access. For a manually actuated slide bolt, throw length, keeper geometry, and strike alignment are specified to achieve a defined engagement depth (e.g., ≥10 mm) and a retention force sufficient to resist a target lateral load without plastic deformation. For an electromagnetic locking apparatus, a mating armature plate is mounted to the post-side locking interface, and the coil body is mounted to the panel-side or vice versa, with wiring routed in conduit or a flexible cable loop rated for outdoor exposure. A fail-open or fail-secure selection may be made based on site risk, with a signage requirement where code mandates. It is intended that release is a response to a minimum aerodynamic speed/load of wind, such as 100 mph or more.

The install automated control system step 660 optionally introduces a controller that is communicatively coupled to the electromagnetic locking apparatus. Meteorological data may be received from a local anemometer or a network service via an authenticated channel. A hysteresis-based algorithm may be implemented: when measured wind speed V(t) exceeds an unlock threshold Vu for a continuous dwell time Tu (e.g., 30-120 s), a transition command is asserted to unlock; re-locking may occur only when V(t) remains below a relock threshold Vr<Vu for a dwell time Tr. Time averaging (e.g., exponential moving average with smoothing constant $\alpha$) may be applied to reduce spurious toggling. The controller may support redundant power modalities (e.g., mains primary, solar-charged battery secondary) and an event log stored in non-volatile memory documenting transitions, sensor faults, and manual overrides. Communications with peripheral sensors may use an industrial protocol or a low-power wireless profile; message integrity checks and watchdog timers may be implemented to enter a safe state upon communication loss.

Returning to the fabricate reinforced solid-sheet panel step 670, the reinforced sheet may incorporate a core such as a honeycomb or corrugated structure bonded between skins, with a bending stiffness D selected to maintain deflection under design pressure within L/180-L/240 criteria, where L is panel span. Edges may be sealed to prevent moisture ingress, and metallic inserts may be embedded at clamp and lock locations to distribute bearing stresses. The sheet may include a surface finish with ultraviolet inhibitors and abrasion resistance appropriate for the intended environment. Where panels must be serviceable, hidden fasteners may be chosen to permit removal and replacement of the sheet without disturbing the rotational member.

Quality assurance checkpoints may be interleaved between steps to verify conformance. After step 632, a run-out measurement of the horizontal pivot axis may be performed with a straightedge and feeler gauges to ensure axial misalignment remains below a set tolerance. After step 640, swing tests may be conducted to confirm that the panel reaches an intermediate angle under a calibrated wind surrogate (e.g., a fan or pull-test), and that no interference occurs at posts or ground. After step 650 or 660, a functional test sequence may issue lock/unlock commands and verify that the locking mechanism actuates within specified current and time envelopes, and that manual override remains operative.

In some embodiments, as illustrated in FIG. 6, method operations 610-670 may be executed in parallel for multiple cartridges to reduce installation time, with jigs standardizing sleeve elevation. For instance, in the example illustrated in FIG. 6, substep 632 may be performed on a workbench for several panels while foundations cure from step 610 at a job site, such that mount panels to posts step 640 can proceed immediately upon reaching required concrete strength.

Signal and power routing associated with step 660 may include surge suppression and ground fault protection, with cable glands rated for ingress protection and ultraviolet exposure. Where solar charging is included, a charge controller and battery pack may be sized using a duty cycle analysis of expected unlock cycles during storm events and a reserve autonomy target (e.g., ≥72 hours without sun).

Industrial applicability includes residential, commercial, coastal, and critical infrastructure perimeters where wind-induced failures are common. The disclosed method enables repeatable assembly with defined tolerances, reducing rework and improving lifecycle cost by spreading maintenance across replaceable subassemblies. It is contemplated that variants with different panel materials, post materials, or coupling hardware may be substituted without departing from the described method, provided that the operations continue to define a horizontal pivot axis, establish a releasable locking mechanism, and enable selective transitions between static and dynamic states.

Figure 7:
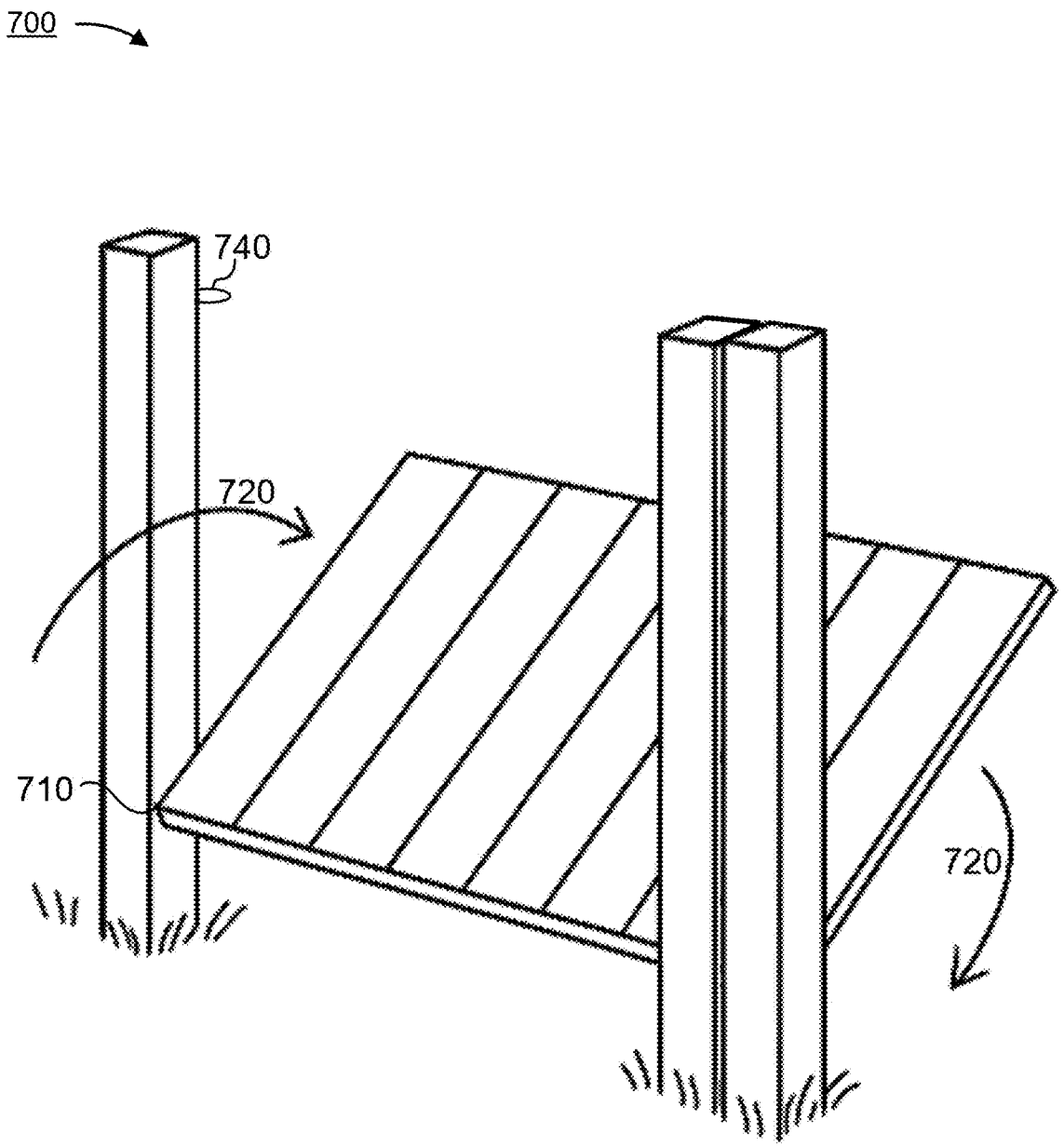
FIG. 7 depicts a dropdown embodiment with a bottom-edge rotational coupling assembly allowing the panel to rotate toward a horizontal orientation proximate to a substrate when unlocked, according to various examples, as shown in some embodiments.

Referring to FIG. 7, which illustrates an overall environment 700 as a "dropdown" yielding fence embodiment, a rotational coupling assembly 710 may be disposed along a bottom horizontal edge of a panel such that the panel may rotate downward toward a ground-contact orientation under aerodynamic loading in a dynamic state. The bottom-edge rotational coupling assembly 710 may extend substantially continuously along a lower margin of the panel, thereby establishing a horizontal pivot axis proximate to a substrate. A rotation direction indicator 720 may depict the direction of rotation under wind load. When wind subsides, the panel may be raised to a fence-like orientation without disturbance to a hinge line defined by 710. A releasable catch on post 740 may be mounted at an elevated position on at least one post to secure the panel in the static state. When engaged, the catch on post 740 may retain the panel in a fixed, non-rotational orientation and may prevent chatter at the top edge. When released, the panel may permit substantially free rotation about the bottom pivot axis in response to wind. The catch geometry may align with an upper rail or stile to distribute load and to reduce localized compression during contact. This figure may emphasize how a system may achieve a substantially horizontal orientation proximate to a substrate in a dynamic state using a bottom-edge continuous hinge as a rotational coupling assembly.

In some embodiments, the bottom-edge rotational coupling assembly (a sleeve and pipe assembly as previously disclosed, or another equivalent hinge or any applicable hinge as known in the art) may be located near 710. The panel's center of mass is located at a vertical offset h above the hinge axis, which produces a restoring moment $M=m\cdot g\cdot h$ in the static condition and dictates the user-applied or wind-induced torque required to initiate rotation. Under wind speed V (m/s), the quasi-steady aerodynamic moment acting about the hinge may be approximated as $Mw\approx(1/2)\cdot\rho\cdot Cd\cdot A\cdot V^2\cdot zcp$, where ρ is air density, Cd is an effective drag coefficient for the panel configuration (typically 1.0-1.3 for solid faces and lower for perforated faces), A is the projected area, and zcp is the moment arm from the hinge axis to the resultant center of pressure. The rotation direction indicator (dropdown) 720 reflects the condition $Mw\approx(m\cdot g\cdot h+\text{frictional resistance})$, at which point the panel begins to descend toward the ground-contact orientation.

The releasable catch on post 740 may be implemented as a mechanical keeper with a captive pin, a compression hasp, or an electromagnetic latch. When mechanical, the catch engagement force Fc should exceed the anticipated service-level hinge moment translated to the catch line ($Fc\geq Mw/rc$, where rc is the lever arm from the hinge to the catch interface), plus a design safety factor (e.g., ≥2.0). When electromagnetic, the latch holding force is selected to meet the same criterion and the device is powered by the system's control infrastructure; upon receipt of a high-wind unlock command, the magnet is de-energized to release the panel. If the catch includes a shield or hood to prevent wind-driven debris from fouling the mechanism, the geometry and clearance stack should be confirmed to avoid scrape or over-travel during panel descent.

In some embodiments, elastomeric bumpers or energy-absorbing stops are installed at or near the predicted ground-contact points to limit impact loads when the panel approaches horizontal. These bumpers may be formed from EPDM or polyurethane with a Shore A hardness of 60-80, sized to distribute impact stresses over the panel's lower rail or stile edges. A controlled "soft close" can be achieved by specifying bumper thickness t and material damping factor so that the deceleration ΔV over the last 5-10 degrees of rotation remains below an angular acceleration threshold that the hinge and fasteners are rated to sustain.

To preserve corrosion resistance and electrical isolation in mixed-metal assemblies, a dielectric barrier film or washer may be inserted between hinge leaves and any dissimilar fasteners attaching the hinge to the panel frame. Grease fittings, if present, are oriented downward or laterally to reduce water ingress; NLGI #2 marine grease may be used for periodic lubrication where rolling bushings or sleeves are integrated within the hinge knuckles. If a bushing material is specified (e.g., acetal, PTFE-bronze composite), its PV rating under anticipated pin pressure and rotational velocity should be documented to validate duty life under storm-induced cycling.

Installation tolerances may be set so that the hinge axis remains colinear with the sleeves and/or the tensioning bands within +/−1-10 mm across the cartridge to avoid binding. The post mounting faces may be plumbed within ±3°, and the panel-to-post gap at the upper edge is maintained between 0.5-2 inches in the static state to prevent collision during initial rotation. The catch 740 position may be aligned with a reinforced region of the panel (e.g., an upper rail), and a strike plate on the post may be recessed or shimmed to ensure consistent engagement without imposing twist on the panel face.

Alternative configurations preserve functional equivalence while modifying manufacturability and serviceability.

The continuous hinge of 710 may be replaced by serial strap hinges or preferably a galvanized hinge, potentially a continuous hinge array, to facilitate replacement of individual hinge segments without panel removal. A dust lip or brush seal may be integrated above the hinge line to reduce grit ingress into the knuckle interfaces; in snowy climates, a raised threshold or standoff pads may be used to keep the hinge clear of accumulating ice layers while not obstructing the final horizontal rest position. Privacy coverings may be individually hinged, wooden, vinyl, or metal pickets/leaves which may be attached to the posts with hinges such as galvanized/outdoor-rated 3" hinges, to enable privacy panels to move out of the way when necessary. When fully opened, the leaves on either side of a pair of side-by-side/flush posts may be connected, such as with a 2" hook-and-eye, or similar latch mechanism to remain open so the yielding fence panels/cartridges can swing in the wind. The panel surface may be reconfigured from discrete pickets to a solid laminated sheet with internal reinforcement to reduce flutter and to lower Cd, thereby reducing Mw at a given wind speed.

In operational sequences, when a control system is present, a high-wind event is detected via a local anemometer or network service, and a command is issued to release the catch 740 (if electromagnetic) or to prompt a user with an alert to manually disengage it. In either case, the panel transitions from the static state to the dynamic state and rotates under aerodynamic loading about the bottom hinge axis established by 710. During the event's decay, either gravity and any biasing element (if installed) return the panel to a liftable position, or the user re-raises the panel and re-engages the catch 740. In installations employing obstruction sensing, a proximity sensor mounted near the panel upper edge may inhibit release if an object is detected within the swing envelope.

For metallic panel frames, welding the hinge pipe directly to a steel or aluminum panel member is contemplated, with appropriate galvanic isolation if dissimilar materials are present. From a structural perspective, finite-element analysis may be used to verify combined stresses at sleeve locations. The panel's natural frequency in the latched condition may be calculated to confirm that vortex shedding at mid-range winds does not induce resonant oscillation; if needed, damping tape or a small viscous damper can be integrated along the post-to-panel interface to attenuate motion.

In some embodiments, as illustrated in FIG. 6, the installation method optionally routes a verification step after the mount panels to posts step 640 to confirm hinge colinearity within the permitted tolerance prior to affixing the releasable locking mechanism in step 650. For instance, in the example illustrated in FIG. 6, a dial-indicator pass along the panel edge is performed to measure maximum out-of-plane deviation during a small-amplitude test rotation; if deviation exceeds a threshold, shim adjustments at hinge fasteners are applied before proceeding.

In field operation, a maintenance routine is scheduled at seasonal intervals. The hinge 710 is inspected for wear or corrosion products, the catch 740 alignment is re-verified, and any elastomeric bumper elements are examined for compression set. Where electromagnetic catches are deployed, the control system executes a self-test cycle that briefly energizes and de-energizes the device to confirm current draw and response, logging any anomalies to a maintenance record.

Industrial applicability is broad: retrofit of existing fence cartridges is enabled by installing the hinge 710 along the panel's bottom edge and adding the catch 740 to the post without altering the property boundary geometry. New installations benefit from the reduced post overturning moment during storm events because the panel yields to wind, thereby potentially reducing required post size or embedment depth while maintaining privacy during calm conditions. If local codes restrict panels from contacting the ground during storms, the bumper or standoff strategy should be adapted to maintain a minimal clearance (e.g., 10-20 mm) with compliant soft stops.

Figure 8:
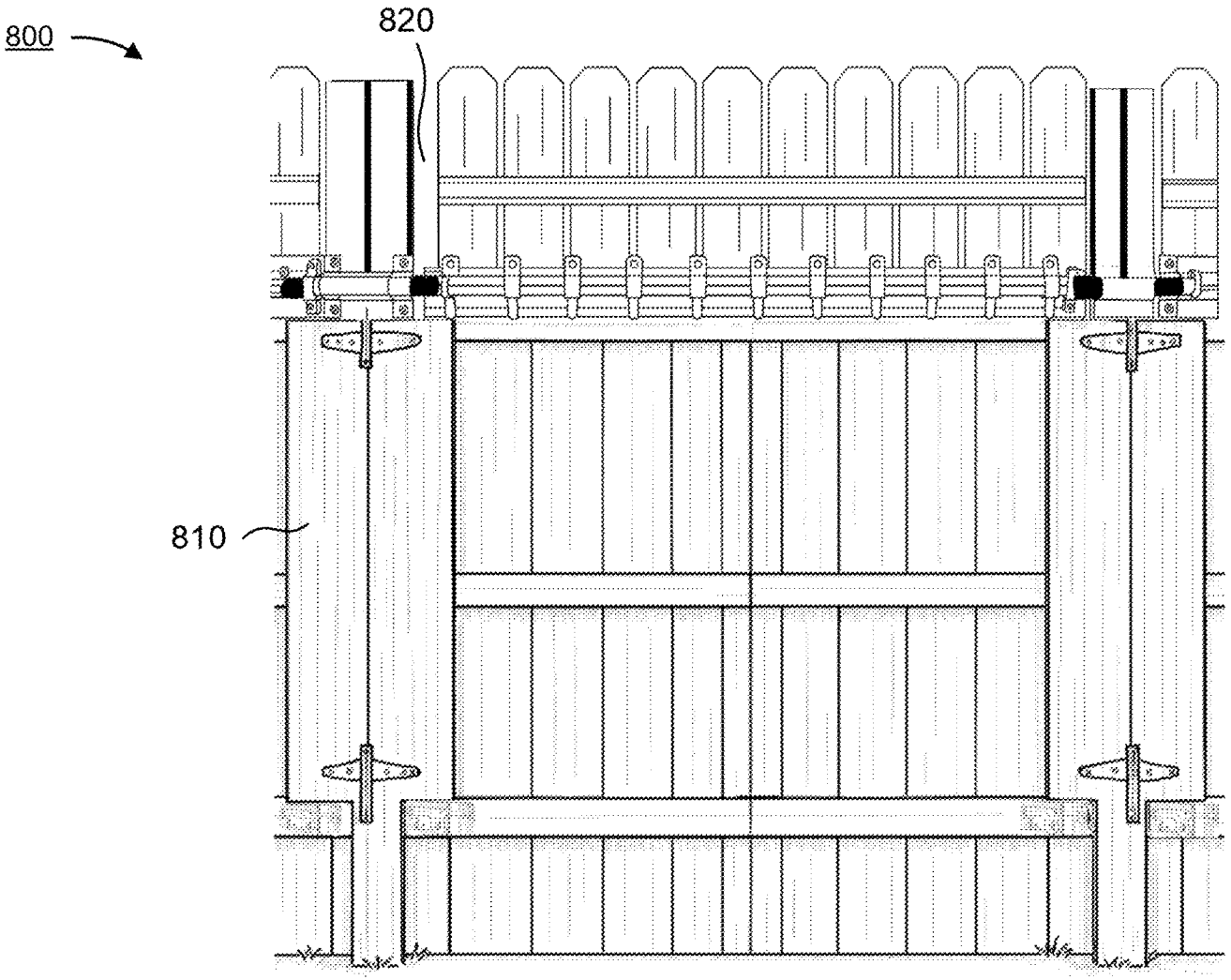
FIG. 8 depicts a swivel picket group embodiment in which clustered pickets rotate about a vertical axis with journaled supports and detent biasing to reduce wind-facing area, according to various examples, as shown in some embodiments.

Referring to FIG. 8, which illustrates an overall environment 800 as a swivel picket group embodiment, clustered fence pickets may rotate about a vertical axis to shed wind without lifting a full-width panel. Each picket group may be carried by a vertical swivel shaft that may define an axis of rotation oriented approximately orthogonal to a ground plane. A space 820 may exist where visual privacy may be compromised in some embodiments where the space 820 is significant in size. The solution is shown in privacy leaves 810, which may be secured by hinges to the posts which are on the other side of gap 820 from the fence cartridge/panel. The leaves preferably have a vertical panel between them (not shown) since there is a chance there is a space between the two side-by-side posts if two are used in the installation as in the preferred embodiment disclosed herein (as opposed to a single post which also could be adapted to). The privacy leaves run vertically as shown and preferably extend lower than shown, past and below the locking pins shown in FIG. 8 visually as just beneath the shorter shown leaves. Each leaf preferably has its own two hinges, though more or less than two could be used. The rest of the description of this figure is intended only for an over-engineered future set of embodiments, not to be claimed in this patent application. A carrier frame for picket group may span across backs of grouped pickets and may transmit wind-induced oscillation/movements into the shaft. A top bearing boss may be fixed to an overhead rail or bracket and may journal the shaft to maintain axial position and alignment. A bottom bearing boss may be fixed to a lower rail or bracket and may complete a two-point journal support that may constrain lateral deflection while allowing rotation. Group size may be three pickets per group as depicted, though group count may vary based on design. Groups may be spaced laterally to avoid interference through a rotation arc and to define inter-group gaps that may reduce effective projected area under wind. A magnetic (or electromagnetic) detent subsystem may bias each group toward a fence-closed alignment and may provide a restoring torque when aerodynamic loading subsides. In certain aspects, rotation limits may be implemented by stop surfaces at the bearing bosses, or along the carrier frame to avoid collision between adjacent groups. This figure may provide an alternative yielding mode compatible with static and dynamic states while using vertical-axis rotation of modular picket clusters.

In one non-limiting design, the vertical swivel shaft is formed from a corrosion-resistant ferrous alloy (e.g., zinc-plated low-carbon steel or 316 stainless steel) with a nominal diameter of 8-16 mm and a straightness tolerance of ≤0.25 mm per 1,000 mm, thereby maintaining concentricity within the top bearing boss and a bottom bearing boss. The carrier frame for picket group may comprise a stamped or extruded metallic spine (e.g., 2-3 mm thick galvanized steel or powder-coated aluminum) with welded or riveted attachment tabs to the picket group, where fastener shear capacity and bearing stresses are sized for a factored wind torque. The magnetic detent subsystem can be implemented using opposed rare-earth magnets (e.g., N35-N52 grades) or a magnet-to-ferrous target, set at an air gap of 1-4 mm to achieve a detent holding torque of 0.5-3.0 N·m per group, tuned such that the threshold for breakaway occurs below the design service wind speed. For wind engineering, panel-level distributed wind pressure p may be estimated using $p \approx 0.00256 \cdot V^2$ (psf) for speed V (mph), and the group yaw torque T about approximated as $T \approx C_d \cdot p \cdot A \cdot r$, where $C_d$ is a form/porosity coefficient (typically 1.0-1.3 for slatted groups), A is projected area of the three pickets in a group, and r is the centroidal lever arm to the shaft; selection of is made such that $T_{detent} < T$ at a wind speed below a target unlocking threshold (e.g., 30-45 mph).

The top bearing boss and bottom bearing boss may use dry-running bushings (e.g., PTFE-lined or oil-impregnated bronze per ISO 3547) with diametral clearance of 0.05-0.20 mm for the chosen diameter, or sealed rolling-element bearings (e.g., 6001-2RS class) when low starting torque and long service life are prioritized. Bushings provide superior debris tolerance and reduced cost; bearings reduce frictional hysteresis, improving small-angle return behavior. Grease fittings or sealed-for-life designs can be selected; in coastal installations, bushings with polymer liners and 316 stainless hardware are preferred to mitigate galvanic couples. If long-term abrasion is expected due to airborne grit, boss/shields and drip edges should be added to limit ingress; verify that the shield does not reduce the required yaw range.

Group yaw range may be limited mechanically by shoulders within bosses, or by stops integral to the carrier frame, establishing a maximum rotation $\pm\theta_{max}$ (e.g., ±35-60°). The stops prevent inter-group collision and preserve privacy geometry in partial-open conditions. Lateral spacing between adjacent picket groups is set such that at $\theta_{max}$, clearance of at least 6-12 mm remains between nearest edges to account for thermal expansion, wood swelling (if wood pickets are used), and installation tolerances.

The carrier frame-to-picket attachments may be threaded fasteners into pre-drilled pilot holes (wood pickets) or blind rivets (metal/composite pickets). Where wood pickets are used, screws should be coated or stainless with dielectric isolators if used with aluminum to avoid galvanic corrosion; the use of sealing washers may improve weathering. Where composite or vinyl pickets are used, integral molded bosses can accept thread-forming screws with pull-out resistance verified per ASTM D1761.

The magnetic detent subsystem may be made adjustable by mounting the magnet on a slotted bracket, enabling service technicians to vary the detent torque by adjusting the air gap. Alternatively, a multi-position magnet carrier may be used to vary effective pole alignment. A soft-iron flux shunt can be inserted to reduce detent force during maintenance. If temperature extremes are anticipated, note that magnet remanence varies with temperature; select grades with appropriate temperature coefficients or provide design margins to maintain detent thresholds over −20° C. to +60° C.

In some embodiments, low-profile reed switches or Hall-effect sensors are co-located with to capture yaw angle or detect an "aligned" (closed) state for reporting to a control system (see 910, 920 in FIG. 9). A control algorithm may read angular state data and implement hysteresis thresholds (e.g., unlock at threshold_1 wind, re-align when measured wind and angle error drop below threshold_2) to avoid chatter. Data may be serialized over a low-voltage bus (e.g., I2C/SPI) to a microcontroller housing; wiring may be concealed along the carrier frame and routed through bosses, to a protected cavity. Where no active control is used, the mechanical provides the sole biasing function and the system remains purely passive.

Alternative configurations include increasing picket group count per cartridge (e.g., four or five), changing picket cross-sections (flat, aerofoil, or louvered), or implementing a dual-shaft per group to increase torsional stiffness for wide pickets. The carrier frame may be uninterrupted across multiple picket groups, with each group's shaft journaled independently; conversely, separate carriers per group simplify replacement. Pickets can include edge chamfers to reduce noise during yaw and to shed water. Detents may be duplicated at both bosses for balanced return torque or concentrated at one boss to simplify installation.

From a manufacturing standpoint, bosses, may be inserted into pre-drilled rails using press-fit features or fasteners; a jig that sets vertical alignment between the two bosses reduces shaft binding. Shafts may include a circlip groove or shoulder to control axial play (<0.5 mm preferred) while allowing free rotation; a thrust washer at one boss may carry axial loads induced by wind asymmetry.

Industrial applicability includes residential privacy fences in hurricane-prone zones, perimeter barriers for commercial sites requiring wind-shedding without catastrophic failure, and temporary event barriers where rapid wind relief is needed without powered actuation. In each instance, the vertical-axis architecture reduces the maintenance burden associated with full-panel lifting designs and maintains partial privacy in partially open states. Energy absorption may be enhanced with elastomer bumpers at end stops to limit impact noise and wear.

The described geometry is compatible with a releasable locking mechanism at the cartridge edges for full fence closure when high winds are not forecast, and can be integrated with electromagnetic locks for security, with sensors confirming group alignment prior to lock engagement. Interoperability with method steps 610-670 (FIG. 6) is achieved by fabricating the picket groups as modular cartridges, integrating bosses/at 630 and 632, mounting assembled groups to the posts at 640 (which are preferably 4"×6" lumber with the shorter 4" face facing the panel cartridges), and, where used, connecting sensor leads during 660.

In a non-limiting computational example, consider a group of three 100 mm wide pickets, 1.8 m tall, with $r \approx 50$ mm, total group area $A \approx 0.3\ m^2$, and $C_d \approx 1.1$; at V=20 m/s (~45 mph), $p \approx 0.5 \cdot \rho \cdot V^2 \approx 0.5 \cdot 1.225 \cdot (20)^2 \approx 245$ Pa (metric form), yielding $T \approx C_d \cdot p \cdot A \cdot r \approx 1.1 \cdot 245 \cdot 0.3 \cdot 0.05 \approx 4.03$ N·m. A detent torque of ~1.5-2.5 N·m would allow yielding before structural overload while maintaining closed alignment under breezes.

Where code compliance is required, components may be validated per ASCE 7 wind load procedures, with group stability checked under serviceability wind speeds and ultimate limit states. Fastener corrosion isolation per coastal exposure categories should be specified, and UV-stable polymers selected for any exposed shields. Tolerances for yaw alignment in the closed state may be ±2° to ensure consistent visual alignment across a long fenceline.

In some embodiments, as illustrated in FIG. 9, a control system 910 optionally routes magnetic detent state signals from Hall sensors near to a processing module that logs cumulative open duration per storm event, permitting maintenance scheduling and lifetime assessment of/bushing wear.

For instance, in the example illustrated in FIG. 6, method step 660 may include configuring detection thresholds for the sensors mounted adjacent to and calibrating the yaw angle reference while groups are aligned in a closed state following installation.

Referring to FIG. 9, which illustrates an overall environment 900 as an electromagnetic lock and control system embodiment, a control system 910 may be mounted to a fence post and may be communicatively coupled to an electromagnetic locking apparatus 930 installed at a panel-to-post interface. An anemometer 920 may be mounted in an unobstructed airflow region and may provide meteorological data to the control system 910. The control system 910 may be configured to automatically transition the electromagnetic locking apparatus 930 from a locked configuration to an unlocked configuration in response to wind speeds exceeding a predetermined threshold, and may re-lock at a lower threshold to implement hysteresis. The electromagnetic locking apparatus 930 may include a magnet/armature pair aligned across a panel edge and a mating surface on a post such that, when energized, the panel may be secured in a fixed, non-rotational orientation in the static state. When de-energized, the panel may be permitted to rotate about a pivot axis in a dynamic state in response to aerodynamic loading. A solar power module 940 may be shown as a post-top photovoltaic unit charging a local energy store to power the control system 910 and the electromagnetic locking apparatus 930. A mains power input 950 may be provided as an alternative or supplemental source. A wiring harness or conduit 960 may interconnect the control system 910, anemometer 920, and lock 930, and may be routed along a post with weather-rated glands at enclosure penetrations to maintain environmental sealing and strain relief. This figure may isolate an automated actuation pathway and power modalities while remaining neutral to specific rotational coupling hardware, thereby supporting upper-edge and bottom-edge pivot implementations. In many aspects, a closed, fixed orientation indicator may denote that the releasable locking mechanism may be engaged and that the panel cartridge may be restrained from rotation about the pivot axis. In some aspects as described herein, a static orientation indicator may be used to designate a fully engaged locking pin condition when a sensor or mechanical flag indicates that a minimum engagement depth has been achieved, for example, by a reed switch or microswitch located inboard of the keeper pocket and wired to a local indicator or the control system of FIG. 9. An indicator location, representing any indicator such as an LED indicator as taught in various embodiments herein, is represented in the figure as the circle wired along the cable between 950 and 930.

In some embodiments, the control system 910 is housed in a NEMA 4X/IP66 enclosure with UV-stabilized polycarbonate or powder-coated aluminum construction and a silicone gasketed door, and is specified for an operating temperature range of −20° C. to +60° C. with conformal-coated PCBs for humidity resistance up to 95% RH non-condensing. A transient surge protection network (e.g., MOVs on AC mains, TVS diodes on low-voltage lines) is integrated to meet IEC 61000-4 immunity standards, with an optional lightning arrestor at the anemometer 920 mast interface to protect the signal input against nearby strikes. The wiring harness/conduit 960 may be liquid-tight flexible nonmetallic conduit (LFNC-B) with strain-relief glands rated IP68; conductor sizing is selected based on run length and voltage drop, e.g., 18 AWG for low-voltage lock coil leads up to 20 m at 12 V with <5% drop, and 14 AWG for solar/battery interconnects carrying up to 10 A.

The anemometer 920 can be a cup, propeller, or ultrasonic sensor providing a speed signal at 1-10 Hz update rate. For analog models, a 0-5 V or 4-20 mA signal is sampled at ≥10 Hz with a digital moving-average filter (e.g., 1-3 s window) and spike rejection (median filter or z-score outlier culling). For pulse-output models (reed or Hall), pulse frequency is converted to wind speed using factory calibration constants stored in nonvolatile memory. Siting height and exposure are considered to reduce installation bias; a mounting bracket may offset the sensor 0.3-0.5 m above the fence line to minimize wake effects from the panels. A calibration routine allows entry of a site factor when terrain shielding is intentional.

In some embodiments, the electromagnetic locking apparatus 930 includes a magnet body on the post and an armature plate on the panel, providing a normal holding force Fh nominally 600-2000 N at 12-24 VDC, depending on selected model. Holding force is sized using wind load estimates, for example, $q_z \approx 0.00256\ V^2$ (psf) at speed V (mph) and panel projected area Ap, yielding a required restraining force $F_r \approx C_d\ q_z\ A_p$ with Cd in the range 0.7-1.2 depending on surface porosity and local geometry. The control system 910 enforces a two-threshold hysteresis, e.g., unlock threshold Vu=55 mph and relock threshold Vr=35 mph, user-configurable in 5 mph increments, with a persistence timer (e.g., 30 s above threshold) to avoid chattering during gust fronts. A debounce period (e.g., 5 s) is applied after state transitions to allow mechanical settling before sampling resumes.

Power subsystem modalities include either a mains power input 950 (90-264 VAC, 47-63 Hz) with Class II isolated SMPS output (e.g., 24 VDC, 3-5 A) or a solar power module 940 (e.g., 50-100 Wp panel) feeding an MPPT charge controller and a sealed LiFePO4 or AGM pack (e.g., 12 V, 20-40 Ah), sized for ≥48 hours standby and ≥25 lock/unlock cycles per outage event at −10° C. Automatic source selection prioritizes solar/battery during outage conditions and reverts to mains when available, with brownout detection and a fail-safe unlock on undervoltage (e.g., <10.8 V for 12 V systems) to conserve coil life and prevent partial energization. A watchdog timer in 910 resets firmware upon missed heartbeats, and a hardware interlock relay is provided to de-energize the lock 930 in case of firmware fault indications.

In some embodiments, the control system 910 uses a microcontroller executing firmware written in C/C++ with a RTOS for deterministic sampling and actuation tasks. A state machine includes states: IDLE-LOCKED, MONITORING, UNLOCKING, IDLE-UNLOCKED, RELocking, and FAULT. Inputs include wind speed, enclosure temperature, power status, door/cover tamper, and optional obstruction sensors. Outputs include lock coil drive (PWM or on/off), status LEDs, and an optional relay or solid-state output for external alarms. Event logs (e.g., timestamped unlocks, peak wind, power transitions) are stored in circular flash buffers (≥1024 entries) and accessible via a local service port (USB-C/TTL serial) or a wireless interface where regulatory permitted.

Communications options may include BLE or Wi-Fi for local commissioning, and optionally cellular or LoRaWAN for remote telemetry. When networked, the control system 910 may retrieve forecast data to preemptively unlock prior to arrival of hazardous wind conditions, with policy constraints to prevent premature unlock if measured local wind remains benign. Over-the-air update (OTAU) mechanisms can authenticate signed firmware images (e.g., Ed25519), with power-loss-safe dual-bank flashing and automatic rollback upon failed validation. Security measures include AES-128/256 encryption for stored thresholds and access control for configuration endpoints.

The wiring harness/conduit 960 layout routes high-current lock lines separately from sensor lines to minimize EMI coupling. For analog anemometers, twisted-pair shielded cable grounded at 910 is recommended. All enclosure penetrations use drip loops and upward-facing grommets to shed water. The armature alignment for 930 is specified within ±1 mm parallelism and <0.5 mm air gap under static conditions to achieve nameplate holding force; a floating armature mounting kit may be used to accommodate thermal expansion and wood movement.

Interactions with mechanical subsystems ensure that unlocking precedes panel motion by at least a control latency Tc (e.g., 150-300 ms including sensor processing, decision, and coil discharge). In integrated systems with the rotational coupling assembly of FIG. 3, axial constraint members are verified to remain engaged during dynamic cycling so lateral drift does not misalign the lock upon relock. In multi-cartridge installations, 910 may coordinate with neighboring controllers through a low-voltage bus to sequence unlocks, reducing instantaneous load on shared power sources.

In algorithmic variants, a gust-factor method may be applied, where an unlock condition is satisfied if the 3 s gust exceeds Vu even if the 10 s average remains below threshold. A secondary condition may evaluate gust frequency and duration to preemptively unlock when a series of threshold-adjacent gusts occurs within a defined window (e.g., 5 events within 2 minutes). A re-lock inhibit timer (e.g., 10 minutes) can be employed after initial unlock to prevent nuisance cycling during squall passages, with a user override available through a secure commissioning interface.

From a compliance perspective, RF emissions and immunity are addressed to FCC/CE requirements; insulation coordination for mains input 950 follows UL/IEC 62368-1 with reinforced insulation and creepage/clearance suitable for Pollution Degree 2. For the solar variant, reverse-polarity protection and backfeed diodes are included; the MPPT controller implements temperature-compensated charge profiles for the selected chemistry. Maintenance intervals may prescribe annual inspection of conduit seals, verification of anemometer bearings, and testing of lock release force. A self-test routine can momentarily de-energize and re-energize 930 during low-wind windows to confirm operational readiness, logging the event.

As illustrated in FIG. 6, method step 660 optionally installs the control system 910 prior to mechanical installation of locks to permit commissioning and threshold tuning using live wind data from 920 before the panels are free to move. For instance, in the example illustrated in FIG. 1, an upper-edge rotational coupling is used; 910 may bias its unlock threshold slightly lower (e.g., −5 mph) to compensate for pendulous startup inertia compared to a bottom-edge configuration shown in FIG. 7.

In modular configurations, multiple locks 930 can be driven in parallel for wide panels, with current-limited drivers to avoid supply dip. Alternatively, a distributed architecture may place a small local driver at each lock with a low-current control line from 910, reducing harness gauge and losses. The system can detect open-circuit or short-circuit conditions by measuring coil impedance; detected faults transition to FAULT state and, if safe, de-energize to unlocked.

For safety, an emergency-unlock input may be provided to integrate with external systems (e.g., fire panel dry contact). Upon activation, 910 immediately de-energizes the lock 930 regardless of wind conditions and logs the source. Tamper switches on 910 and shrouds over 930 may generate alerts without affecting lock state, depending on site policy; tamper events are time-stamped.

Where standards or codes require, an optional manual mechanical override can be co-located with 930, allowing decoupling even in case of electronics failure. The override is guarded to prevent accidental actuation and is labeled per applicable standards. In coastal environments, stainless fasteners and dielectric isolators are recommended to mitigate galvanic corrosion per claim language; all exterior sealants shall be neutral-cure silicone or polyurethane compatible with enclosure materials.

CONCLUSION

For clarity of explanation, the above description has focused on a representative sample of all possible embodiments, a sample that teaches the principles of the invention and conveys the best mode contemplated for carrying it out. The invention is not limited to the described embodiments. Well known features may not have been described in detail to avoid unnecessarily obscuring the principles relevant to the claimed invention. Throughout this application and its associated file history, when the term "invention" is used, it refers to the entire collection of ideas and principles described; in contrast, the formal definition of the exclusive protected property right is set forth in the claims, which exclusively control. The description has not attempted to exhaustively enumerate all possible variations. Other undescribed variations or modifications may be possible. Where multiple alternative embodiments are described, in many cases it will be possible to combine elements of different embodiments, or to combine elements of the embodiments described here with other modifications or variations that are not expressly described. A list of items does not imply that any or all of the items are mutually exclusive, nor that any or all of the items are comprehensive of any category, unless expressly specified otherwise. In many cases, one feature or group of features may be used separately from the entire apparatus or methods described. Many of those undescribed alternatives, variations, modifications, and equivalents are within the literal scope of the following claims, and others are equivalent. The claims may be practiced without some or all of the specific details described in the specification. In many cases, method steps described in this specification can be performed in different orders than that presented in this specification, or in parallel rather than sequentially, or in different computers of a computer network, rather than all on a single computer. It is to be understood that the present technology contemplates that, to the extent possible, one or more features of any implementation can be combined with one or more features of any other implementation.

While the above description details certain embodiments of the invention and describes the best mode contemplated, no matter how detailed the above appears in text, the invention can be practiced in many ways. Many aspects of this disclosure are meant to be overkill for defense against hurricanes such as category 5 hurricanes and windstorms. Therefore, implementation details may vary considerably while still being encompassed by the invention disclosed herein. Particular terminology used when describing certain features or aspects of the invention should not be taken to imply that the terminology is being redefined herein to be restricted to any specific characteristics, features, or aspects of the invention with which that terminology is associated.

What is claimed:

1. A yielding fence system configurable between a static state and a dynamic state, comprising:
   a plurality of structural support posts;
   at least one panel disposed between two of said plurality of structural support posts;
   a rotational coupling assembly pivotally attached near an upper or lower edge of the panel, connecting said panel to said two support posts, said rotational coupling assembly comprising:
      a singular, horizontally orientated cylindrical pipe member, and
      a pair of sleeve members, each sleeve member affixed to one of the support posts, and configured to rotationally receive and end of the cylindrical pipe member; and
   at least one releasable locking mechanism configured to:
      selectively secure said panel in a fixed, non-rotational orientation in the static state, and
      to permit substantially free and/or 360 degrees of rotation of said panel about a pivot axis in the dynamic state in response to aerodynamic loading.

2. The yielding fence system of claim 1, wherein in the dynamic state, the panel rotates from a bottom edge of the panel in a pendulous motion.

3. The yielding fence system of claim 1, wherein in the dynamic state, the panel rotates to a substantially horizontal orientation proximate to a substrate.

4. The yielding fence system of claim 1, wherein: said cylindrical pipe member and said pair of sleeve members are fabricated from galvanized steel, and the releasable locking mechanism comprises a manually actuated slide bolt.

5. The yielding fence system of claim 1, further comprising a plurality of tension bands securing the cylindrical pipe member to a structural frame of the panel.

6. The yielding fence system of claim 1, wherein each of said plurality of structural support posts comprises a 4-inch by 6-inch dimensional lumber post having a total length of at least 9 feet, and wherein each post is anchored in a substrate to a depth of at least 33% of a height of the length of said post.

7. The yielding fence system of claim 1, wherein the panel is a self-contained panel cartridge having a horizontal width of less than 5 feet, thereby defining a surface area engineered to reduce torsional stress on the rotational coupling assembly during wind-induced oscillation.

8. The yielding fence system of claim 1, wherein a gap between the fence system panel and the posts is covered for privacy.

9. The yielding fence system of claim 1, wherein the releasable locking mechanism comprises an electromagnetic locking apparatus communicatively coupled to a control system.

10. The yielding fence system of claim 9, wherein the control system is configured to automatically transition the electromagnetic locking apparatus from a locked configuration to an unlocked configuration in response to receiving data indicative of wind speeds exceeding a predetermined threshold.

11. The yielding fence system of claim 10, wherein said data is received from a local anemometer integrated with the fence system.

12. The yielding fence system of claim 1, further comprising at least one axial constraint member affixed to the rotational coupling assembly, said axial constraint member configured to prevent horizontal translation of the panel relative to the two support posts.

13. A method for manufacturing a hurricane-resistant fence system comprising the yielding fence system of claim 1, the method comprising steps of:
   installing the plurality of structural support posts in a substrate;
   fabricating a plurality of panels;
   integrating the rotational coupling assembly with each of said plurality of panels;
   mounting each panel between a pair of the structural support posts by pivotally connecting the rotational coupling assembly to said pair of structural support posts; and
   affixing a releasable locking mechanism operable to selectively prevent and permit rotation of each panel.

14. The method of claim 13, wherein the panels are fabricated as groups of wooden or vinyl or aluminum pickets, and wherein the step of fabricating the panel cartridges comprises fastening a plurality of individual wood pickets to a rigid perimeter frame using threaded deck screws.

15. The method of claim 13, wherein the step of integrating the rotational coupling assembly comprises defining a horizontal pivot axis by affixing a singular cylindrical pipe to a rigid perimeter frame of the panel via a plurality of tension bands.

16. The method of claim 13, further comprising the step of installing an automated control system configured to actuate the releasable locking mechanism based on meteorological data.

17. The method of claim 13, wherein the step of fabricating a panel comprises utilizing a solid sheet of vinyl internally reinforced with a rigid structural core.

* * * * *